US012691989B2

(12) United States Patent
Whelan

(10) Patent No.: US 12,691,989 B2
(45) Date of Patent: Jul. 28, 2026

(54) DECK FILL FOR USE IN VEHICLES

(71) Applicant: Big Dog Marine LLC, Highland, MI (US)

(72) Inventor: Sean Whelan, Highland, MI (US)

(73) Assignee: Big Dog Marine LLC, Highland, MI (US)

( * ) Notice: Subject to any disclaimer, the term of this patent is extended or adjusted under 35 U.S.C. 154(b) by 417 days.

(21) Appl. No.: 18/385,292

(22) Filed: Oct. 30, 2023

(65) Prior Publication Data

US 2024/0140582 A1 May 2, 2024

Related U.S. Application Data

(60) Provisional application No. 63/420,317, filed on Oct. 28, 2022.

(51) Int. Cl.
*B63J 2/00* (2006.01)
*B63B 17/00* (2006.01)

(52) U.S. Cl.
CPC ..... *B63J 2/00* (2013.01); *B63B 17/0027* (2013.01)

(58) Field of Classification Search
CPC ..... B63J 2/00; B63B 17/0027
See application file for complete search history.

(56) References Cited

U.S. PATENT DOCUMENTS 4,796,777 A * 1/1989 Keller ..... F16K 24/042 220/203.27
6,293,609 B1 * 9/2001 Xu ..... B60J 1/10 52/204.591
8,464,764 B1 6/2013 Milsom
8,960,473 B2 2/2015 Grun et al.
9,096,124 B2 8/2015 Whelan et al.
9,186,982 B2 11/2015 Baldwin et al.
9,290,373 B2 3/2016 Marsala et al.
9,409,476 B2 8/2016 Randolph et al.
9,669,706 B2 6/2017 Koukan et al.
9,855,840 B2 1/2018 Kito et al.
9,873,320 B2 1/2018 Young
9,902,258 B2 2/2018 Young
(Continued)

FOREIGN PATENT DOCUMENTS

EP 1895145 A2 * 3/2008 ..... A01D 34/82
WO 2020020696 1/2020
WO 2022139319 6/2022

*Primary Examiner* — Stephen P Avila
(74) *Attorney, Agent, or Firm* — Clark Hill PLC

(57) ABSTRACT

An improved deck fill for use according to the present invention comprises a vented deck fill with a body, a fuel throat, a vent throat, and a single pressure regulating valve. Use of the single pressure regulating valve increases engine performance by reducing a pressure necessary to push the single pressure regulating valve into an open configuration. This disclosure additionally relates to a method for the installation of the vented deck fill by way of a single hole installation. This is facilitated by an elliptical circumference of the vent throat and fuel throat, thereby allowing the vent throat and fuel throat to be closer together, reducing the necessary size for the single installation hole. This disclosure relates to non-vented deck fills utilizing a floating puck assembly, and to a low-profile fuel cap for vented and non-vented deck fills utilizing a push button latch and hinge clearance scallops.

19 Claims, 41 Drawing Sheets

(56) References Cited

U.S. PATENT DOCUMENTS

| | | | |
|---|---|---|---|
| 10,011,169 | B2 | 7/2018 | Suzuki |
| 10,093,175 | B2 | 10/2018 | Kito et al. |
| 10,245,941 | B2 | 4/2019 | Koukan |
| 10,384,534 | B2 | 8/2019 | Guardianelli |
| 10,723,222 | B2 | 7/2020 | Jeon |
| 11,155,157 | B2 | 10/2021 | Nistler et al. |
| 11,325,463 | B2 | 5/2022 | Mimura |
| 11,358,856 | B2 | 6/2022 | Lee et al. |
| 2020/0384853 | A1 | 12/2020 | Mimura |
| 2022/0242226 | A1 | 8/2022 | Wetzel et al. |

* cited by examiner

DECK FILL FOR USE IN VEHICLES

CROSS REFERENCE TO RELATED APPLICATIONS

This application claims priority to, and the benefit of, U.S. Provisional Patent Application No. 63/420,317 filed on Oct. 28, 2022.

TECHNICAL FIELD

The present disclosure relates generally to the field of deck fills for use in vehicles. More specifically, the present disclosure relates to vented and non-vented deck-fills for use in marine vehicles.

BACKGROUND

A typical fuel system for motorized equipment generally includes a fuel entry point, or fuel fill, that is fluidly coupled to a fuel tank. In marine vehicles such as boats, the fuel fill is often referred to as a deck fill and is typically configured to be mounted into the deck or hull of the vehicle. Deck fills typically define a body and a fuel throat. The body in turn defines an opening or mouth into which a fuel nozzle may be inserted. In some instances, a fuel hose connects the deck fill to the fuel tank.

During the refueling process, fuel such as gasoline or diesel typically enters the marine vehicle via the deck fill and travels down the fuel hose to the fuel tank. As fuel enters the fuel tank, it displaces air and produces fuel vapors that must be vented from the fuel system. Conversely, as the marine vehicle burns the fuel stored in the fuel tank, the resulting negative pressure creates a vacuum, and an influx of air from an exterior environment is required to equalize the pressure in the fuel system. Thus, many fuel systems additionally comprise a vent line that runs from the fuel tank to the exterior environment to regulate air and vapor in the fuel tank.

There are two types of deck fills typically used in the industry: vented deck fills, and non-vented deck fills. In addition to the body, mouth, and fuel throat, a vented deck fill also includes a vent throat. The vent throat connects the vent line to the deck fill body near the mouth to facilitate exchange of air and vapors in and out of the fuel system.

In contrast, a non-vented deck fill does not include a vent throat and instead simply comprises the fuel throat extending from the body of the deck fill. In such instances, ventilation of the fuel tank generally occurs through a different means, and pressure is regulated at a different location in the fuel system, such as through a carbon canister system.

In some instances, vented deck fills additionally include a plurality of valves to regulate the pressure in the fuel system. During refueling, when the pressure inside the fuel tank reaches a predetermined maximum threshold, it pushes the plurality of valves into an open configuration, thereby allowing vapor to exit the fuel system. Conversely, when the pressure in the fuel tank reaches a predetermined minimum threshold, such as when the fuel is being burned during use of the marine vehicle, the plurality of valves are pushed into an open configuration that allows air to enter the fuel system, filling the vacuum in the fuel tank.

Air flow in and out of the fuel system is a key component in proper engine fuel supply and engine operation. In the prior art, the plurality of small valves regulates pressure within the fueling system regardless of whether one of the valves becomes damaged or clogged. However, the more valves utilized, the larger the pressure required to push the valves into the open configuration due to an increased edge, or circumferential, surface area in contact with a valve housing. The higher the surface area, the higher the restriction, and the more work an engine of the marine vehicle must expend to push open the valves. If the restriction is too high, the engine can overheat and seize. Accordingly, there is an unmet need for deck fills where a smaller amount of work is required to regulate pressure, thereby increasing engine performance.

Other difficulties in the prior art involve the installation of vented deck fills, which is generally done via a two-hole system. In a typical vented deck fill, the fuel throat and vent throat extend from the body as parallel pipes. Thus, to install the deck fill in a boat, two holes need to be drilled in juxtaposition, one for the fuel throat and one for the vent throat. To ensure that both holes are covered by a deck fill flange, the fuel throat and vent throat must be close together. As a result, the two holes must overlap, making it difficult to drill the second hole, and increasing the time, labor, and expense of the installation of deck fills. Accordingly, there is an unmet need for vented deck fills that can be installed using a single-hole method.

Both vented and non-vented deck fills typically include a fuel cap which covers the deck fill mouth when the fuel nozzle is not inserted, and which can be removed during refueling. Fuel caps in accordance with the prior art are generally thick and bulky, and do not lay flush with an exterior surface of a boat or other marine vehicle. Instead, deck fill caps generally extend 20-30 mm out from a hull or deck, increasing the risk that a user may stub his/her toe on the fuel cap, or that fishing lines or tie ropes may catch on the fuel cap. Moreover, the typical, protruding fuel cap is not aesthetically pleasing. Thus, there is an unmet need for a low-profile fuel cap for deck fills.

SUMMARY

The present disclosure provides for an improved deck fill for use in marine vehicles, such as boats. In some embodiments, the improved deck fill defines a vented deck fill with a single, large, pressure regulating valve. The larger size of the valve provides a larger valve surface area upon which a fuel system pressure may act while simultaneously reducing a periphery surface area in contact with a valve housing, thereby reducing the amount of pressure necessary to operate the valve. This decreased pressure minimizes the amount of extraneous work required by a marine vehicle engine, thereby increasing the efficiency and performance of the engine.

The current disclosure further provides a method for installing vented deck fills utilizing a single-hole system. This method uses a vented deck fill with a vent throat and a fill throat that have elliptical circumferences, thereby allowing a gap between the vent throat and fill throat to be smaller than a traditional circular circumference would allow. This in turn facilitates installation of the vented deck fill into a single hole, as opposed to the concentric holes, or overlapping two-hole system required in traditional installation methods of the prior art. The single hole method provided by this disclosure may further utilize a vented deck fill that may additionally comprises a plurality of centering ribs around the fill throat and vent throat to center the deck fill in the single hole during installation, thereby easing the installation process.

Another embodiment comprises a non-vented deck fill that includes a floating "puck" assembly that is mounted via screws through a flexible rubber joint to allow movement of the puck when closing a deck fill cap. The rubber joint acts as a spring to equalize force exerted on the puck during closing, thereby allowing a lower closing force to be applied by a user.

In some embodiments, the floating puck of the non-vented deck fill, and the single pressure regulating valve of the vented deck fill, are held within the associated deck fill by a rubber gasket. In preferred embodiments, the gasket is an E-seal gasket with an upper channel and a lower channel. In such embodiments, the vented deck fill or non-vented deck fill may additionally comprise a rigid crown that sits atop the gasket and limits or prevents the gasket from radially flexing away from the puck or valve in response to internal fuel system pressures.

The present disclosure further provides a deck fill with a low profile when installed in the deck or hull of a marine vehicle. This low profile is enabled by a push button assembly, and hinge clearance scallops.

A preferred embodiment of the present invention comprises:

A vented deck fill for use in a vehicle, the vented deck fill comprising:
- a cap;
- a flange having a flange outer diameter and being connected to the cap;
- at least one pressure regulating valve;
- a deck fill body, the deck fill body comprising:
  - a fuel throat body portion and a vent throat body portion;
  - a mouth having a mouth cross-sectional area;
  - an atrium;
  - a fuel throat defined by the fuel throat body portion, the fuel throat body portion having a fuel throat length; and
  - a vent throat defined by the vent throat body portion, the vent throat body portion having a vent throat length, and the fuel throat body portion and the vent throat body portion having an outer throat diameter;
- wherein the at least one pressure regulating valve is seated on the flange and extends through the mouth into the atrium;
- wherein the flange outer diameter is greater than or equal to the outer throat diameter;
- wherein the at least one pressure regulating valve has a valve working area that is between 3% and 25% of the mouth cross-sectional area.

A method for installing a vented deck fill in a marine vehicle, the method comprising the steps of:
- providing a boat hull of the marine vehicle;
- providing a deck fill comprising:
  - a cap;
  - a flange having a flange outer diameter;
  - an at least one pressure regulating valve;
  - a deck fill body, the deck fill body comprising:
    - a fuel throat body portion and a vent throat body portion;
    - a mouth having a mouth cross-sectional area;
    - an atrium;
    - a fuel throat defined by the fuel throat body portion, the fuel throat body portion having a fuel throat length; and
    - a vent throat defined by the vent throat body portion, the vent throat body portion having a vent throat length, and the fuel throat body portion and the vent throat body portion having an outer throat diameter;
  - wherein the at least one pressure regulating valve is seated on the flange and extends through the mouth into the atrium;
  - wherein the flange outer diameter is greater than or equal to the outer throat diameter;
- drilling a single circular hole into the boat hull, the singular circular hole having a diameter that is greater than or equal to the outer throat diameter; and
- inserting the vented deck fill into the single circular hole.

A preferred embodiment of a non-vented deck fill comprises:

A non-vented deck fill for use in a vehicle, the non-vented deck fill comprising:
- a cap;
- a flange connected to the cap;
- a floating puck assembly comprising:
  - a puck body having a top side;
  - a mounting pad affixed to the top side of the puck body and comprising a sealing ring, the sealing ring comprising a biasing means;
- a deck fill body, the deck fill body comprising:
  - a fuel throat body portion;
  - a mouth having a mouth cross-sectional area;
  - an atrium;
  - a fuel throat defined by the fuel throat body portion, the fuel throat body portion having a fuel throat length;
- wherein the floating puck assembly is seated on the flange and extends through the mouth into the atrium.

Preferred embodiments for both vented and non-vented deck fills comprise:

A deck fill for use in a vehicle, the deck fill comprising:
- a cap;
- a flange connected to the cap;
- an at least one pressure regulating valve or a floating puck assembly, the floating puck assembly comprising:
  - a puck body having a top side;
  - a mounting pad affixed to the top side of the puck body and comprising a sealing ring, the sealing ring comprising a biasing means;
- a gasket defining an upper channel and a lower channel, the single pressure regulating valve or the floating puck assembly being seated in the upper channel of the gasket;
- a deck fill body, the deck fill body comprising:
  - a fuel throat body portion;
  - a mouth having a mouth cross-sectional area;
  - an atrium;
  - a fuel throat defined by the fuel throat body portion, the fuel throat body portion having a fuel throat length;
- wherein the at least one pressure regulating valve or the floating puck and extends through the mouth into the atrium.

BRIEF DESCRIPTION OF THE DRAWINGS

The invention will be more fully understood by referring to the following Detailed Description of Specific Embodiments in conjunction with the Drawings, of which.

DETAILED DESCRIPTION OF SPECIFIC EMBODIMENTS

Embodiments of the present invention relate generally to deck fills for use in marine vehicles. The present disclosure describes, in detail, specific embodiments with the understanding that the present invention may be susceptible to embodiments in different forms, and that the present disclosure is considered an exemplification of the principles of the invention and is not intended to limit the invention to that described herein.

As used in this disclosure, the term "down" or "downward" refers directionally towards a fuel tank of a motor vehicle, while the term "up" or "upwards" refers to a direction pointed away from the fuel tank and towards an exterior atmosphere outside the vehicle.

Figure 1:
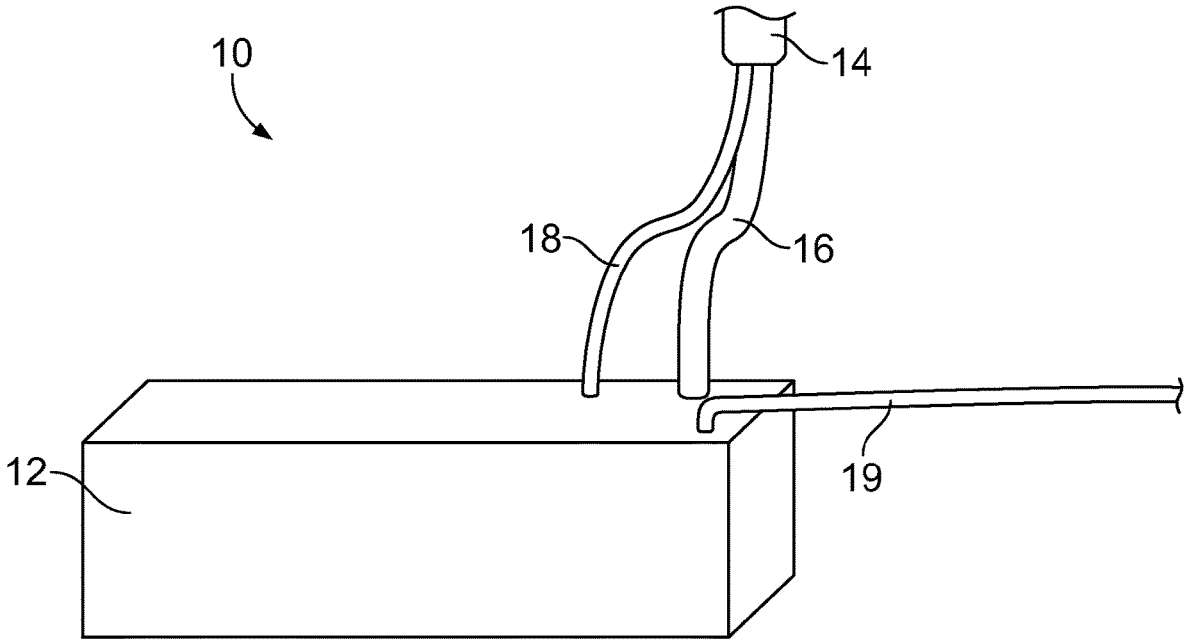
FIG. 1 (Prior Art)
FIG. 1 is a perspective view of a typical fuel system provided in accordance with the prior art.

FIG. 1 is a perspective view of a typical fuel system 10 of a vehicle in accordance with the prior art. Generally, the fuel system 10 comprises a fuel tank 12 that is fluidly connected to a fuel fill 14. This is sometimes accomplished by clamping a fuel line or hose 16 to the fuel fill 14, such that the fuel line 16 runs between the fuel fill 14 and the fuel tank 12. During refueling of the marine vehicle, a fuel nozzle is inserted into the fuel fill 14 and penetrates down to the fuel hose 16. Liquid gasoline, diesel, or other fuel is then discharged to fill the fuel tank 12. To regulate pressure, the typical fuel system 10 may also comprise a vent hose 18 that regulates air and vapor entry and egress from the fuel system 10. An engine line 19 additionally connects the fuel tank 12 to an engine.

Figure 2:
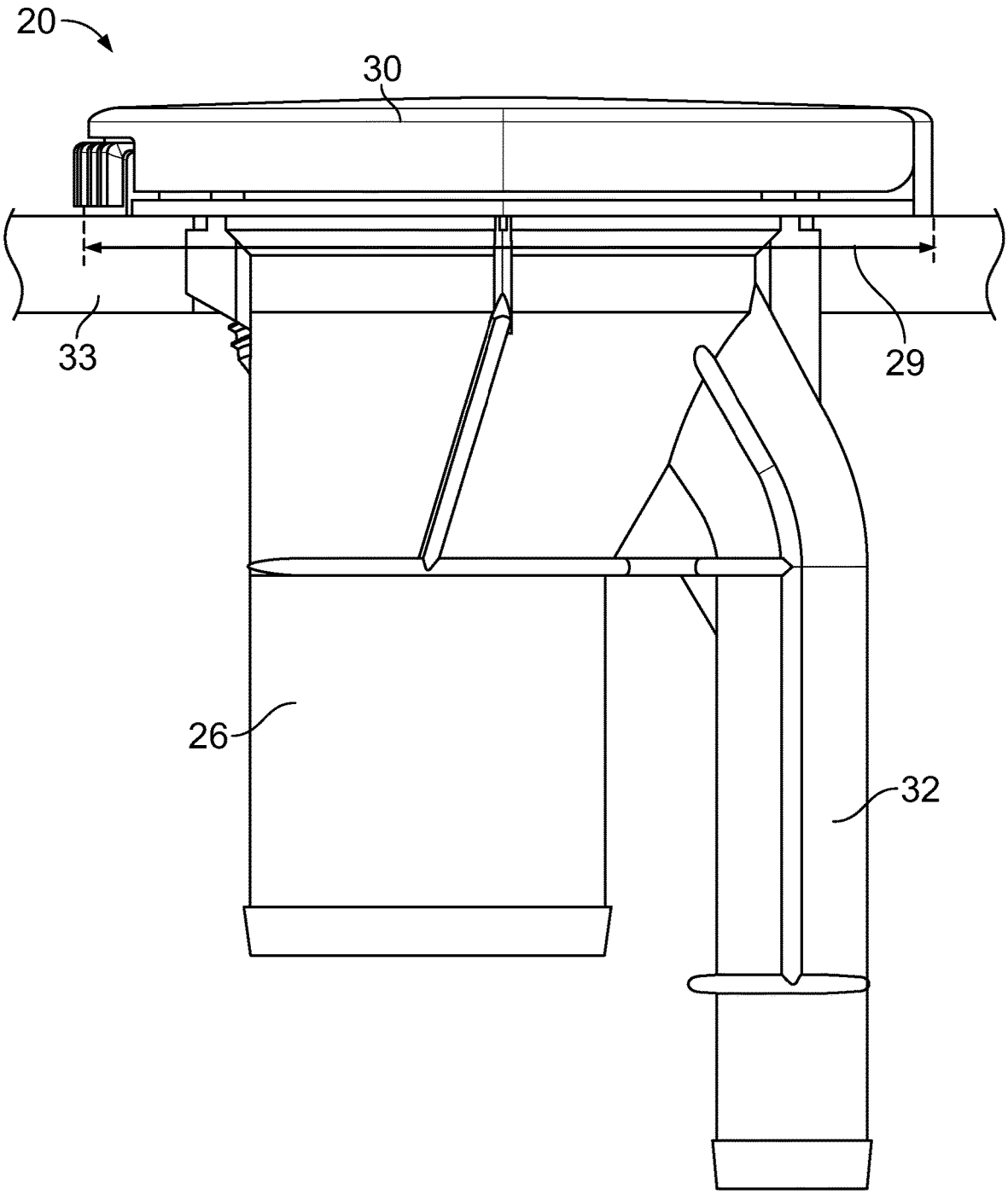
FIG. 2. is a perspective view of a vented deck fill provided in accordance with an embodiment of the current disclosure.
Figure 3:
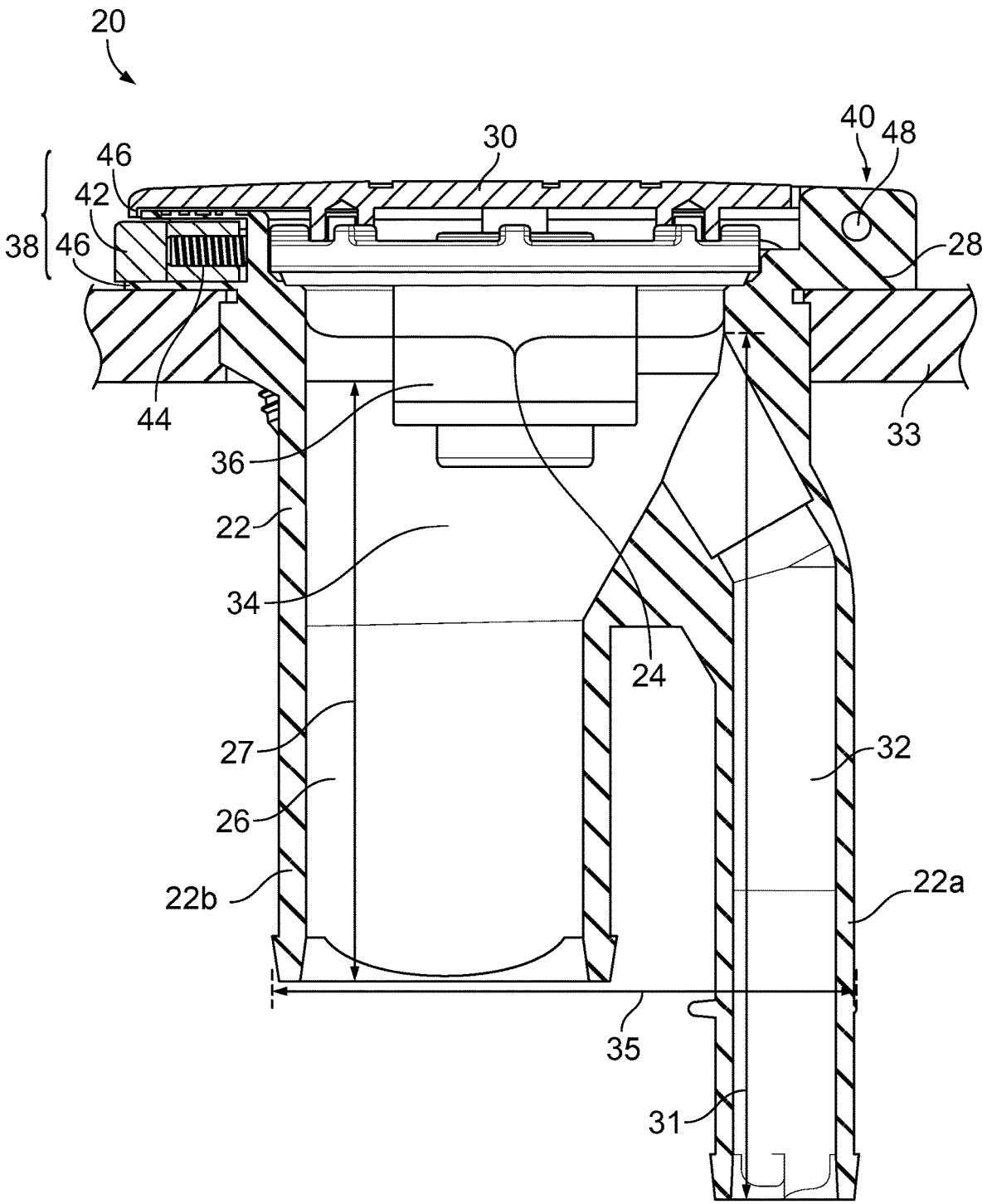
FIG. 3 is a cross section view of a vented deck fill provided in accordance with an embodiment of the current disclosure.
Figure 4:
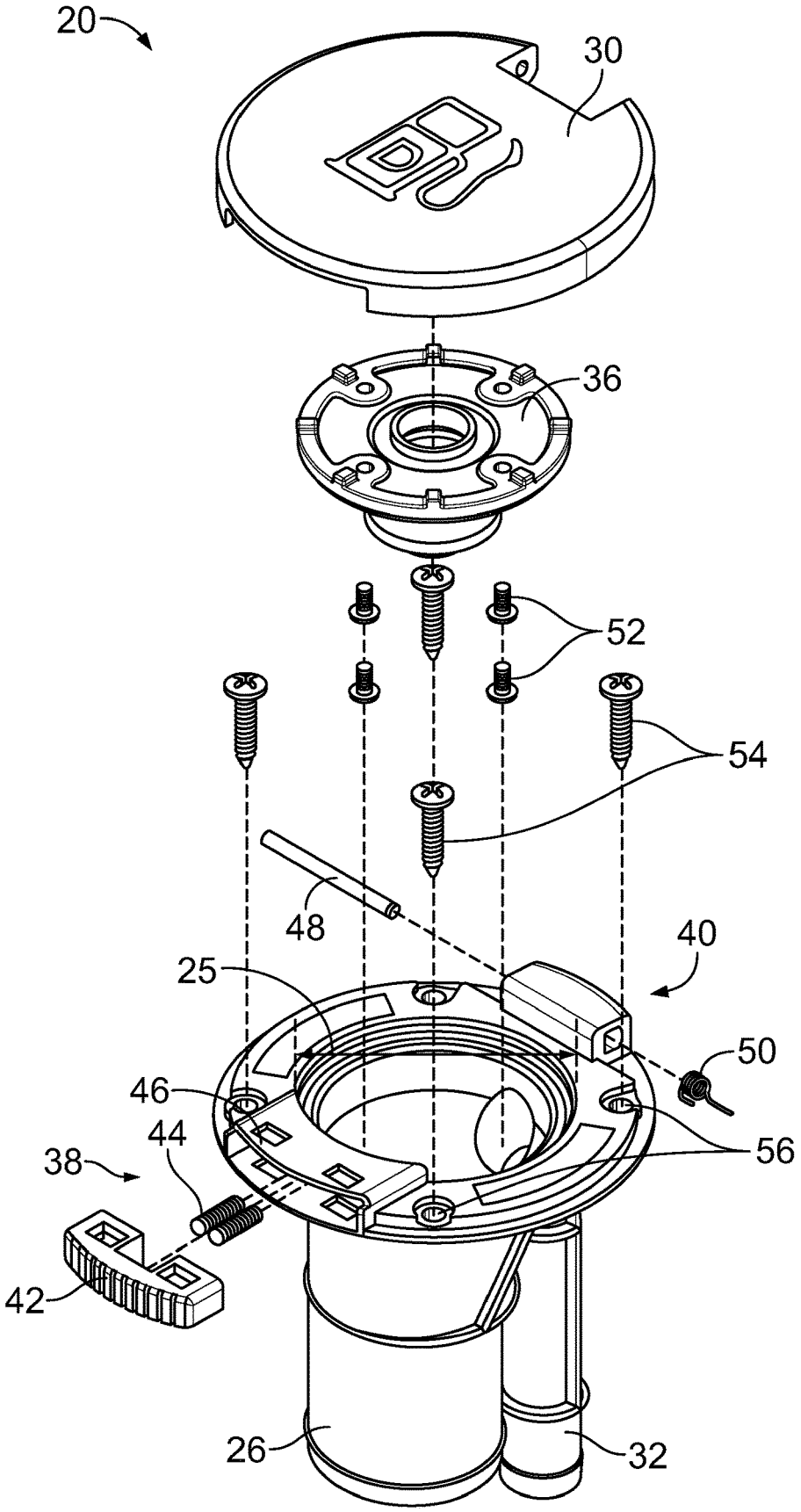
FIG. 4 is an exploded view of a vented deck fill provided in accordance with an embodiment of the current disclosure.
Figure 20:
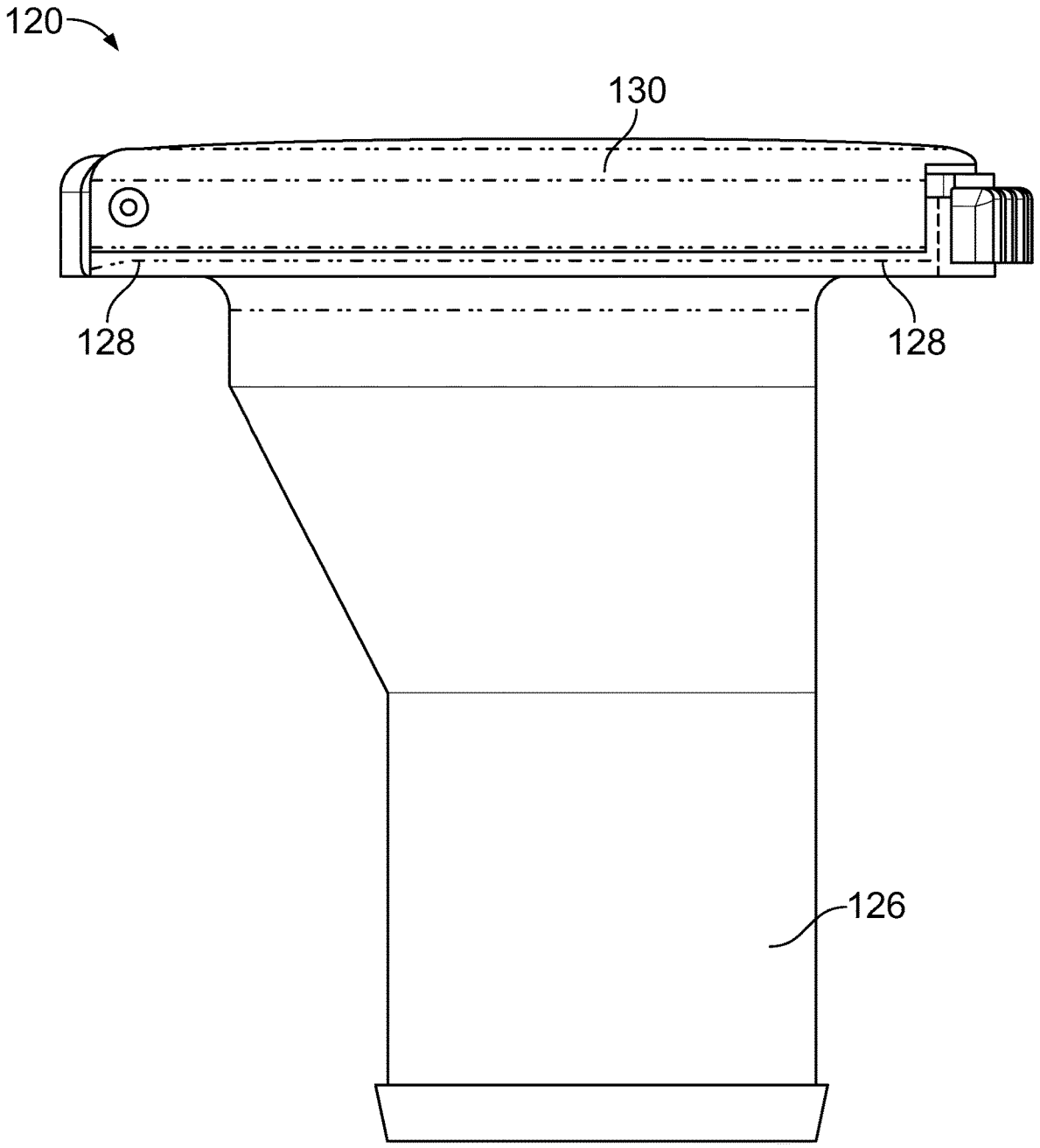
FIG. 20 is a perspective side view of a non-vented deck fill provided in accordance with an embodiment of the current disclosure.
Figure 21:
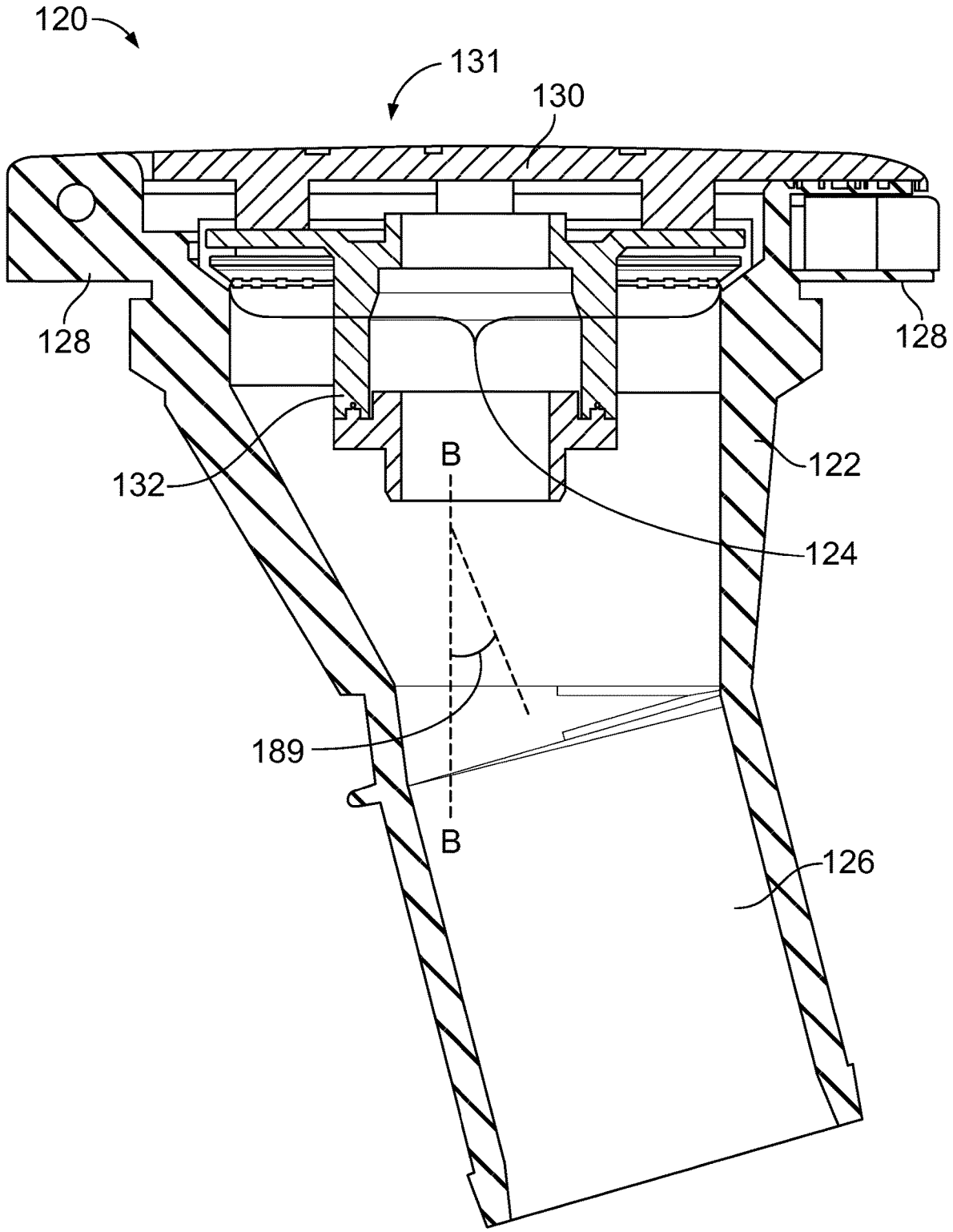
FIG. 21 is a cross section view of a non-vented deck fill provided in accordance with an embodiment of the current disclosure.
Figure 22:
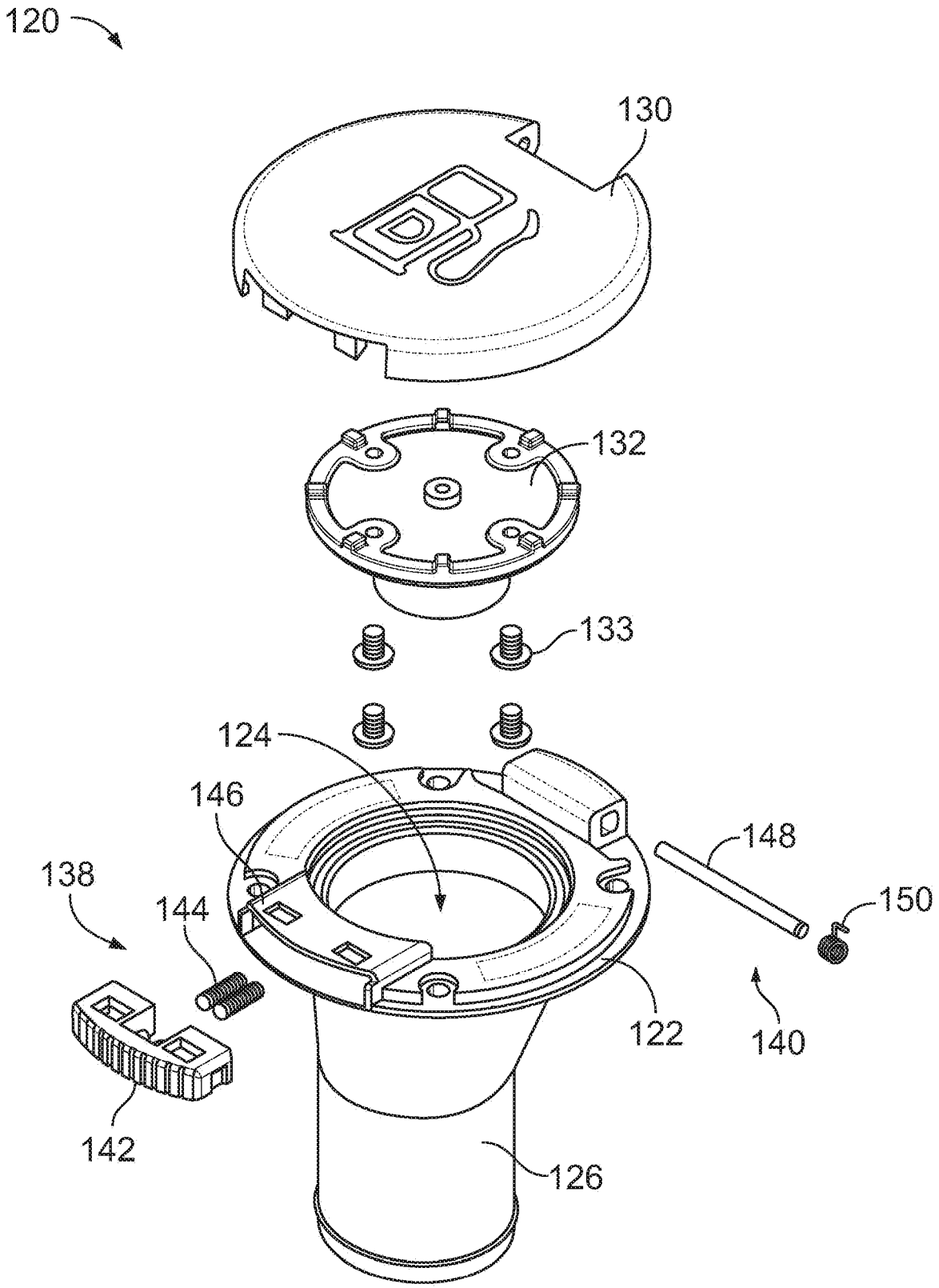
FIG. 22 is an exploded view of the non-vented deck fill of FIG. 20.

The deck fills disclosed are preferably components in fuel systems of marine vehicles and may define a vented deck fill 20 as shown in FIGS. 2-4, or a non-vented deck fill 120 as shown in FIGS. 20-22. Notwithstanding the use of different reference numerals in the embodiments, some component parts of the deck fills 20, 120 described in the current disclosure may be the same or similar. For example, both the vented deck fill 20 and the non-vented deck fill 120 preferably comprise a body 22, 122, an opening or mouth, 24, 124 defined by the body 22, 122, a fuel throat 26, 126, a flange 28, 128 and a fuel cap 30, 130.

FIG. 2 is a perspective view of a vented deck fill 20 provided in accordance with an embodiment of the present disclosure. FIG. 3 is a cross sectional view of the same. As illustrated in FIGS. 2 and 3, the vented deck fill 20 is installed in a boat hull 33 or deck. In addition to the body 22, fuel throat 26, flange 28, and fuel cap 30, the vented deck fill 20 additionally comprises a vent throat 32, an atrium 34 (defining a section of the body where the fuel throat 26 and vent throat 32 join in the body 22), and a single pressure regulating valve 36 seated on the flange 28 and extending through the mouth 24 into the atrium 34. The flange 28 has a flange outer diameter 29 and is preferably connected to the cap 30. The flange outer diameter 29 is preferably the largest diameter of the deck fill 20, and is preferably larger than an installation hole such that the flange 28 sits on an outside of the installation hole. The fuel throat 26 is defined by a fuel throat body portion 22*b* having a fuel throat length 27. Likewise, the vent throat 32 is defined by a vent throat portion of the body 22 (vent throat body portion 22*a*) and has a vent throat length 31. In combination, the fuel throat 26 and vent throat 32 have an outer throat diameter 35 defined as the distance from an outermost point of the fuel throat 26 to an outermost point of the vent throat 32 (i.e., both the fuel throat 26 and vent throat 32 fit within the outer throat diameter 35). The embodiment illustrated in FIG. 3 shows a vented deck fill 20 wherein the throat diameter 35 is larger than a diameter of the installation hole. In such embodiment, the vented deck fill 20 is inserted into the installation hole at an angle and is then tilted to set vertically with the fuel throat 26 and vent throat 32 within the installation hole, and such that the flange 28 sits on the outside the installation hole. Some embodiments additionally comprise a button assembly 38, and a hinge clearance scallop 40 that hingedly connects the cap to the flange. Collectively, the button assembly 28 and the hinge clearance scallop 40 facilitate movement of the fuel cap 30 into an open and closed position such that the fuel cap 30 is latched when in the closed position. Components of the button assembly 38 may additionally comprise a push button 42, a compression spring 44, and a button housing 46. Components of the hinge clearance scallop 40 may comprise a hinge pin 48.

Figure 7:
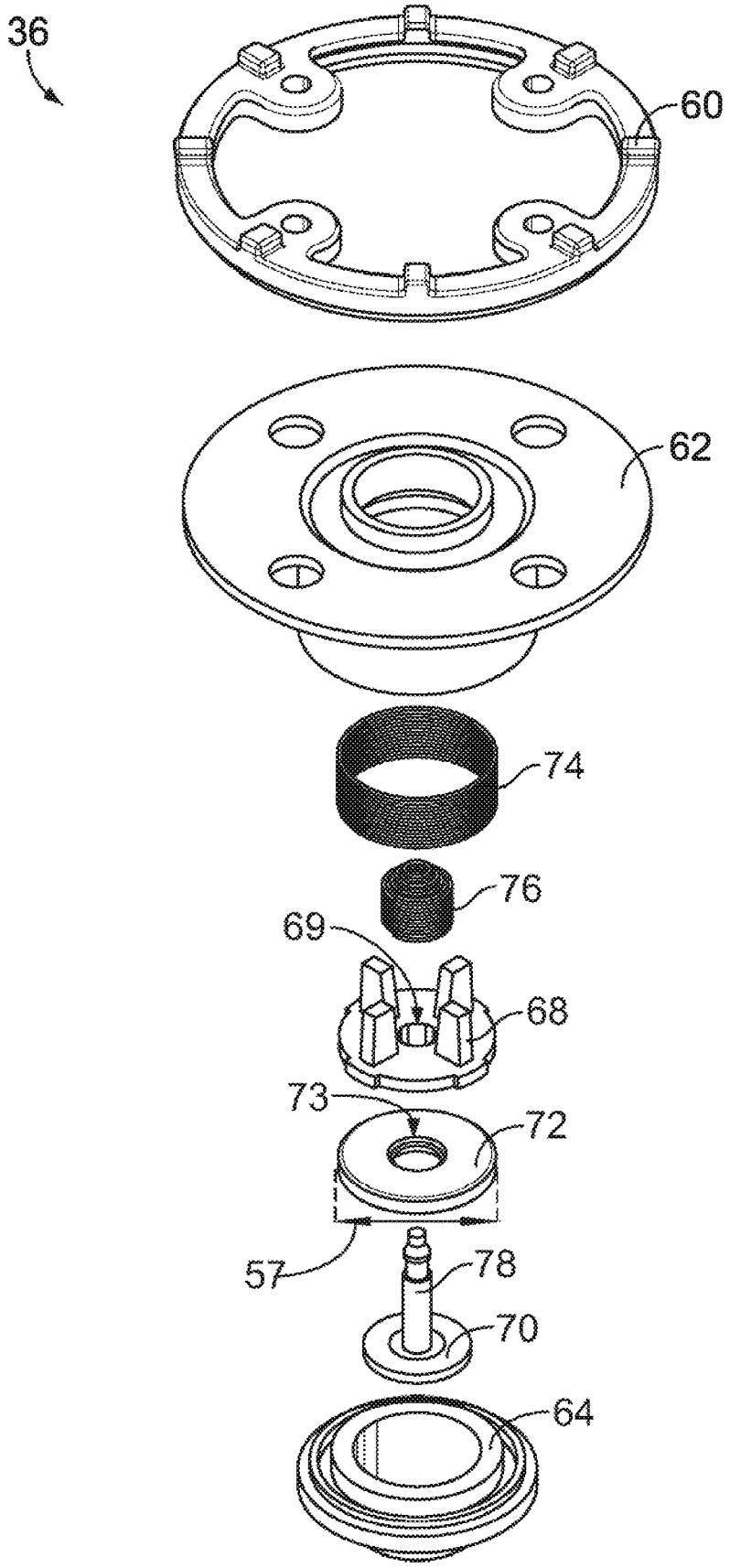
FIG. 7 is an exploded view of the valve of FIG. 5.

FIG. 4 is an exploded view of the vented deck fill 20 illustrating the assembly of the single pressure regulating valve 36, and a preferred method of fastening the deck fill 20 to the boat hull 33. In some embodiments, the single pressure regulating valve 36 may be affixed to the fuel cap 30 by a plurality of machine screws 52. However other fastening systems are anticipated by this disclosure, such as regular screws, bolts, latching mechanisms, epoxies, or other methods known in the art. The vented deck fill 20 is itself preferably fastened to the boat hull 33 or deck by way of a plurality of deck screws 54, or by some other means. Again, other fastening systems are anticipated by this disclosure, such as regular screws, bolts, latching mechanisms, epoxies, or other methods known in the art. The deck screws 54 preferably insert through a plurality of flange holes 56. FIG. 4 further illustrates the components of the button assembly 38 and the hinge clearance scallop 40, including the positional relationship between the push button 42 and the compression spring 44. In some embodiments, in addition to the hinge pin 48, the hinge clearance scallop 40 additionally comprises a torsion spring 50. FIG. 4 further illustrates a mouth cross-sectional area 25. A valve working area with diameter 57 is illustrated in FIG. 7.

During refueling of the marine vehicle, fuel enters the fuel tank, displacing air and fuel vapors. This increases an internal pressure in the fuel system as the air seeks to escape. The vent throat 32 is preferably fluidly connected to the fuel tank by a vent hose and provides an avenue for air and fuel vapors to escape through the mouth 24 into an exterior environment. Conversely, when the marine vehicle is in operation, it utilizes fuel stored in the fuel tank, creating a negative internal pressure (i.e., an internal pressure that is lower than an exterior environment pressure) in the fuel system. The vent throat 32 thus also facilitates an influx of air from the exterior environment to fill a vacuum created in the fuel tank when the vehicle burns fuel.

Air flow in and out of the fuel system is a critical component in regulating engine fuel supply and engine operation. In the prior art, a plurality of small valves, located in a variety of locations, including but not limited to valves within a vent throat or at a connection of the vent hose 18 and the fuel tank 12, regulate pressure within the fueling system 10. Typically, the plurality of small valves are housed within the fuel cap of typical deck fills. However, the more valves utilized, the smaller they have to be to fit in the deck fill, and the larger a pressure needs to be to push the valves into an open configuration. The smaller the plurality of valves, the smaller a working surface area per valve, and the more sensitive the valves are to variations in counterbalancing force. In other words, the smaller a valve is, the more sensitive it is to minimal changes in fuel system pressure, resulting in larger pressure tolerances of the associated fuel system. Conversely, a larger valve has a larger working surface area, and thus a smaller pressure tolerance, resulting in lower pressure on the associated fuel system. Thus, utilization of the large, single pressure regulating valve 36 in embodiments of the current disclosure reduces the amount of work an engine of the vehicle must expend to push open the valve, which in turn increases engine performance.

The plurality of valves used in the prior art typically have a working area of 10 $mm^2$, while the preferred single pressure regulating valve 36 in accordance with the current disclosure may have a working area 57 of 80 $mm^2$. However, other working areas 57 are contemplated by this disclosure. In some embodiments, the valve working area 57 is between 3% and 25% of a cross section area 25 of the mouth 24. In preferred embodiments, the valve working area 57 is between 5% and 10% of a cross section area 25 of the mouth 24.

Thus, a diameter of the valve working area 57 is smaller than the diameter of the single pressure regulating valve 36. In preferred embodiments, the single pressure regulating valve 36 is 1.043 inches, or 26.50 mm in diameter, and inserts 0.610 inch (15.50 mm) into the atrium 34 of the vented deck fill 20. However, other valve sizes are contemplated by this disclosure, and it is contemplated that the single pressure regulating valve may have a diameter between 21.2 and 31.8 mm, and that the single pressure regulating valve may insert between 12.4 and 18.6 mm.

Figure 5:
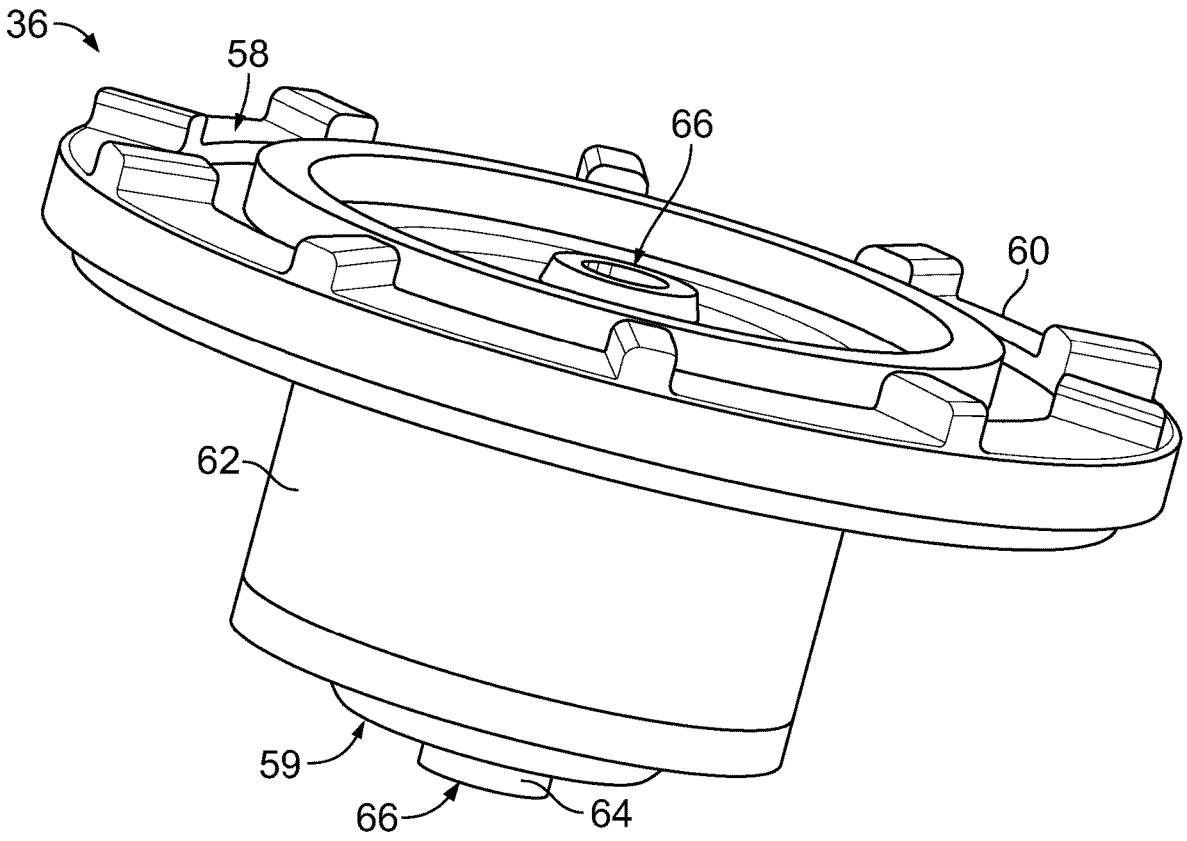
FIG. 5 is a perspective view of a valve utilized in a vented deck fill provided in accordance with an embodiment of the current disclosure.

FIGS. 5-12 show the components and action of the single pressure regulating valve 36. FIG. 5 is a perspective view of the single pressure regulating valve 36 of the vented deck fill 20. The pressure regulating valve 36 preferably has a top side 58 in juxtaposition with the fuel cap 30, and a bottom side 59 extending into the atrium 34 towards the fuel tank. In preferred embodiments, the single pressure regulating valve 36 includes a valve seal 60, a valve body 62, and a valve cap 64, where the valve body 62 and valve cap 64 define a valve channel 66 whereby air and fuel vapors may pass through the single pressure regulating valve 36 when in the open configuration. In preferred embodiments the single pressure regulating valve 36 is affixed or embedded within an interior surface of the fuel cap and extends into the atrium 34, as seen in FIGS. 3 and 4.

Figure 6:
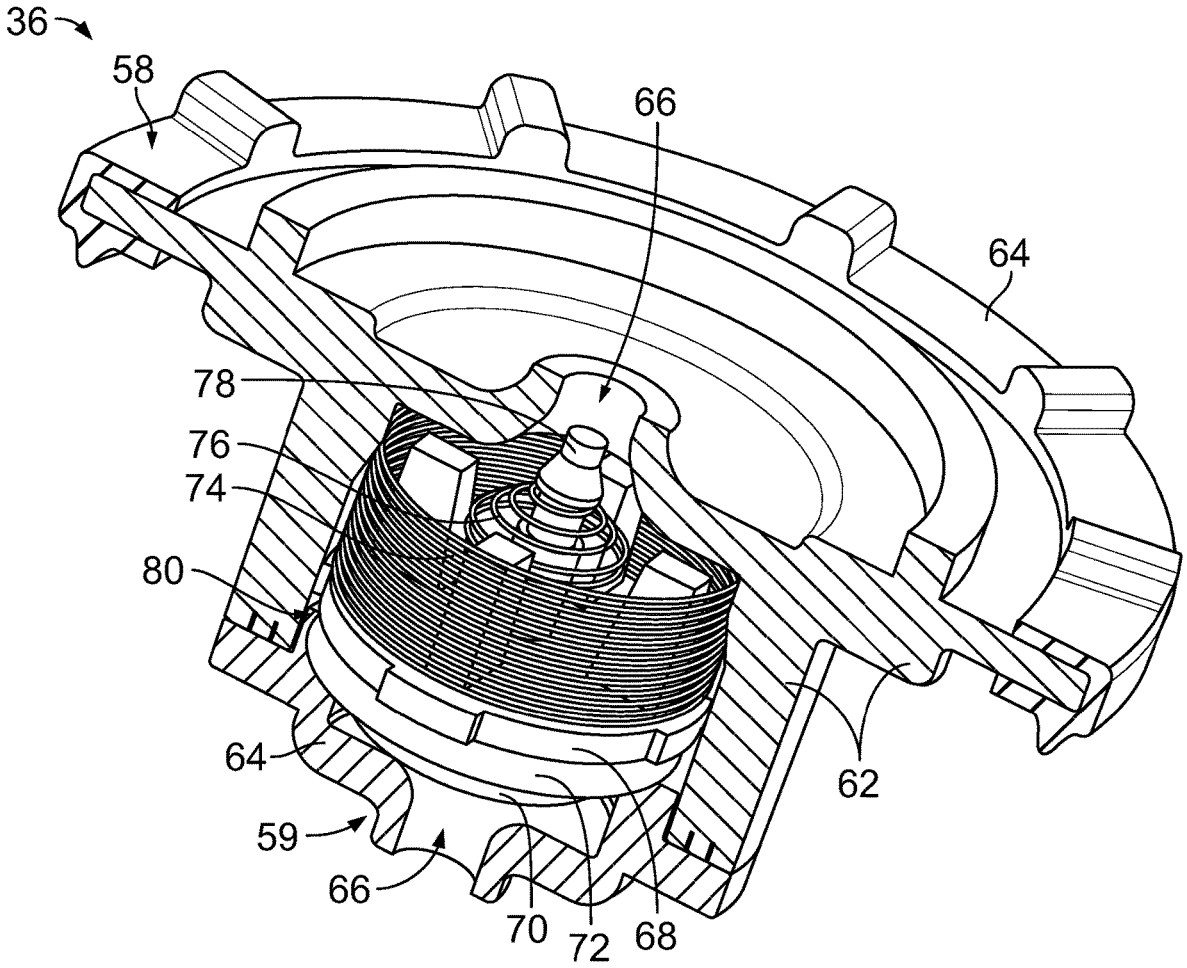
FIG. 6 is a cross sectional view of the valve of FIG. 5.

FIGS. 6 and 7 further illustrate internal components of the single pressure regulating valve 36. The internal components preferably include a big door 68, a small door 70, a door seal 72 between the big door 68 and the small door 70, a big spring 74, a small spring 76, and a valve rod 78, all of which are housed in a large chamber 80 defined by the valve body 62. The valve working area 57 may in some embodiments have the same area as the big door 72. The valve channel 66 is defined by the body 62 and extends between the valve cap 64 into the large chamber 80, and out through the top 58 of the single pressure regulating valve 36.

When the valve is in a closed configuration, the big door 68 and small door 70 block off the valve channel 66, thereby restricting air and vapor flow through the single pressure regulating valve 36. The big spring 74 pushes the big door 68 downwards toward the valve cap 64 in the direction of the fuel tank, maintaining the single pressure regulating valve 36 in the closed configuration.

Figure 8:
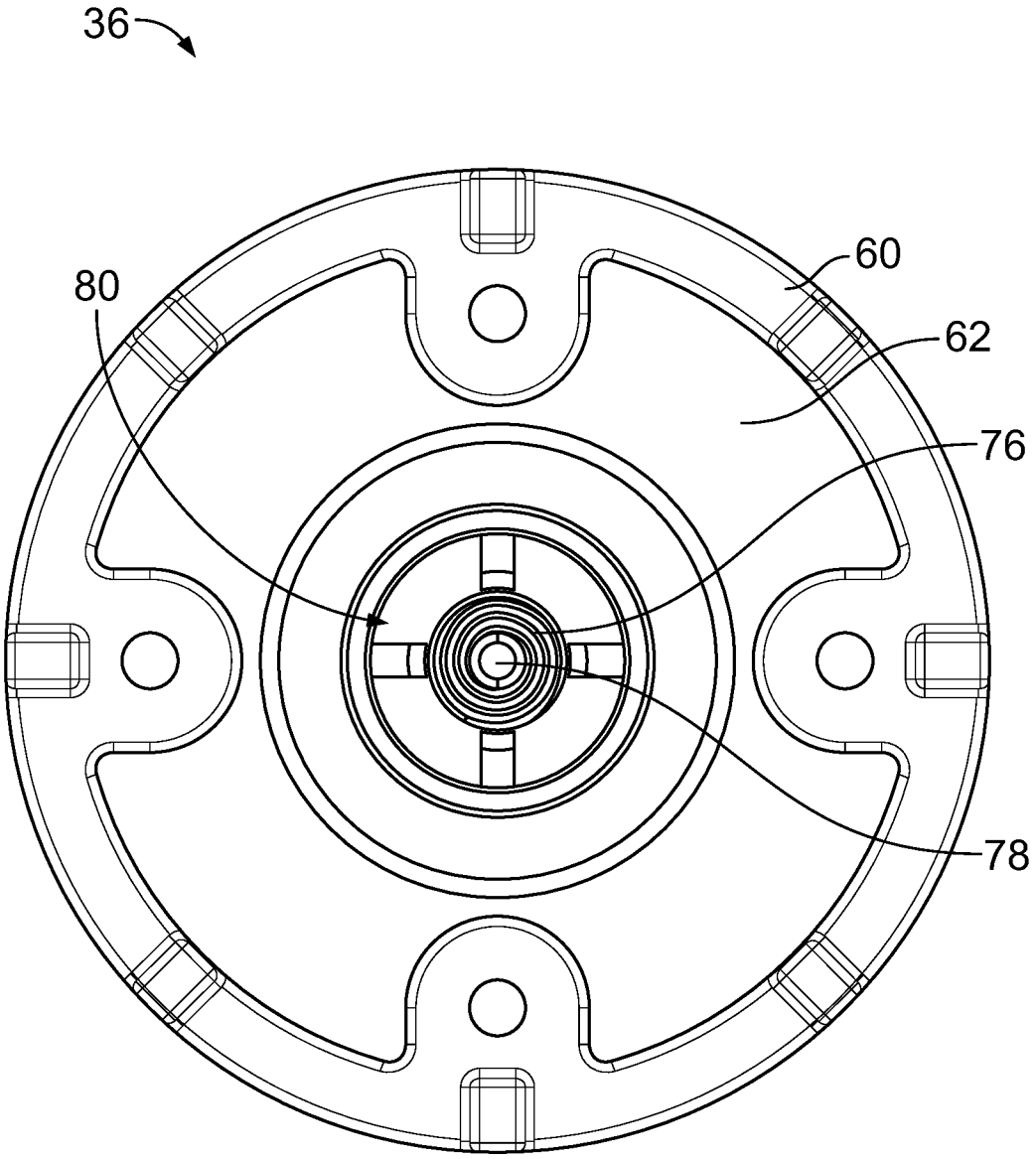
FIG. 8 is a perspective top view of the valve in FIG. 5.

As seen in FIGS. 6 and 7, the small spring 76 encircles the valve rod 78, which passes through a seal hole 73 defined in and by the door seal 72. The valve rod 78 also passes through a door hole 69 defined in and by the big door 68 and extends upwards through the large chamber 80. FIG. 8 is a perspective top view of the single pressure regulating valve 36, looking down into the large chamber 80 and illustrating the small spring 76 encircling the valve rod 78. In the closed configuration, the small spring 76 pulls the small door 70 upwards against the big door 68. The small door 70 thus covers the door hole 69 and seal hole 73 in the door seal 72 and big door 68. The door seal 72, which is thus sandwiched between the small door 70 and the big door 68, prevents the flow of air through the door hole 69 when the small door 70 is in the closed configuration.

Figure 9:
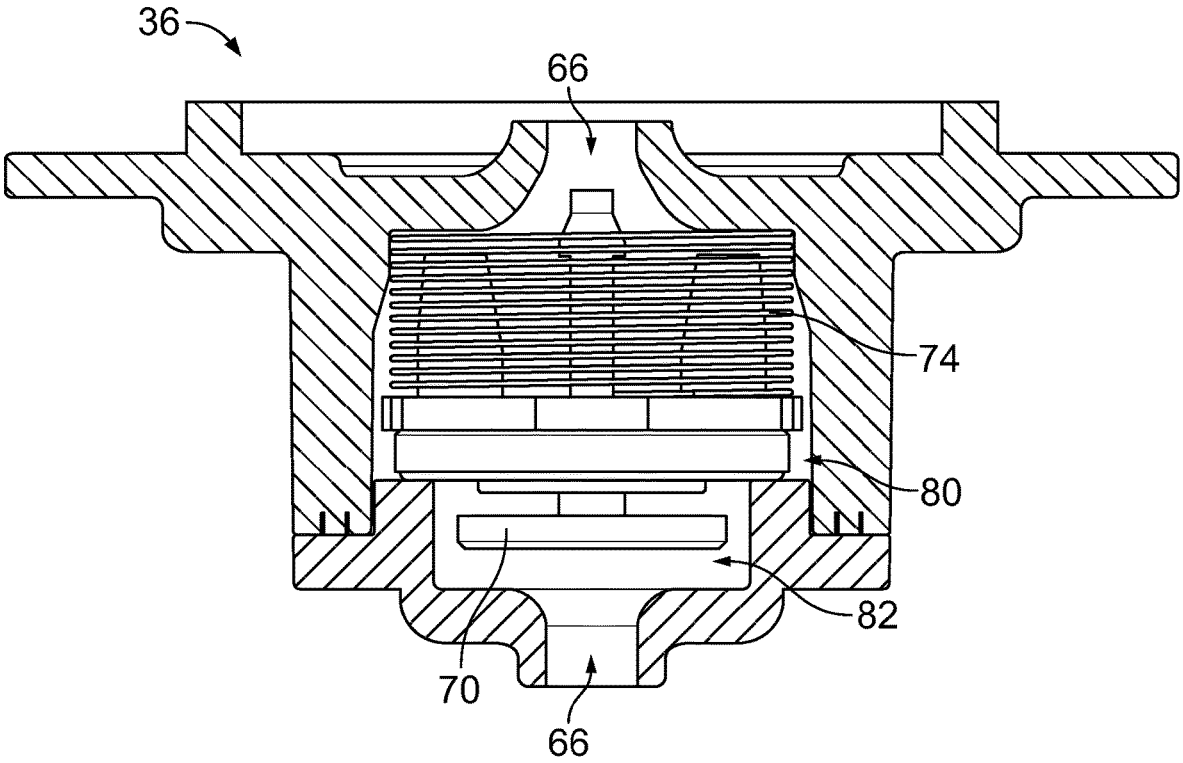
FIG. 9 is a cross sectional view of the valve of FIG. 5, wherein a small door of the valve is in an open configuration.

FIG. 9 is a cross sectional view of the single pressure regulating valve 36 when the pressure in the fuel system meets a minimum threshold where a pressure of the exterior atmosphere exceeds the pressure within the fuel tank by a predetermined amount. In preferred embodiments, the predetermined amount, or cracking pressure, is 0.3 kPa. In such instances, the fuel system has a negative pressure in relation to the exterior atmosphere pressure, and the exterior atmosphere pressure can "push" the small door 70 into an open configuration, as described further infra. When the minimum threshold is met, the exterior pressure will push down on the small door 70, stretching the small spring 76, and pushing the small door 70 into a recess chamber 82 defined by the valve body 62 and extending below the large chamber 80. In such instances, the big door 68 is in a closed configuration, but the small door 70 is in an open configuration, due to a negative pressure within the fuel system.

Figure 10:
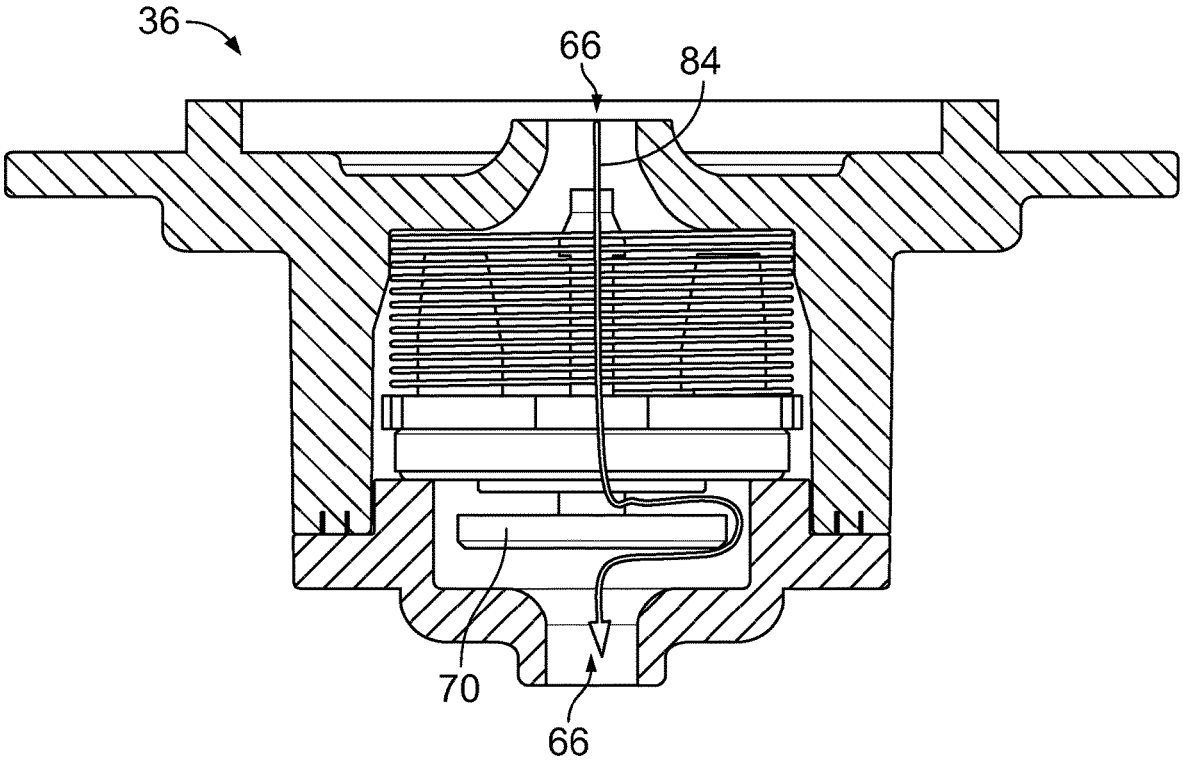
FIG. 10 is a cross sectional view of the valve in FIG. 9, illustrating a negative pressure air flow through the valve.

FIG. 10 further illustrates the negative pressure, and a negative pressure air flow 84 wherein the small door 70 is in the open configuration, thereby allowing air from the exterior environment to travel through the valve channel 66, through the door hole 69, and through the seal hole 73. In such instances, air from the exterior environment travels around the small door 70, and into the fuel tank. When enough air has traveled into the fuel tank to bring the fuel system pressure back up to the minimum threshold, the small spring 76 will pull the small door 70 back up into the closed configuration.

Figure 11:
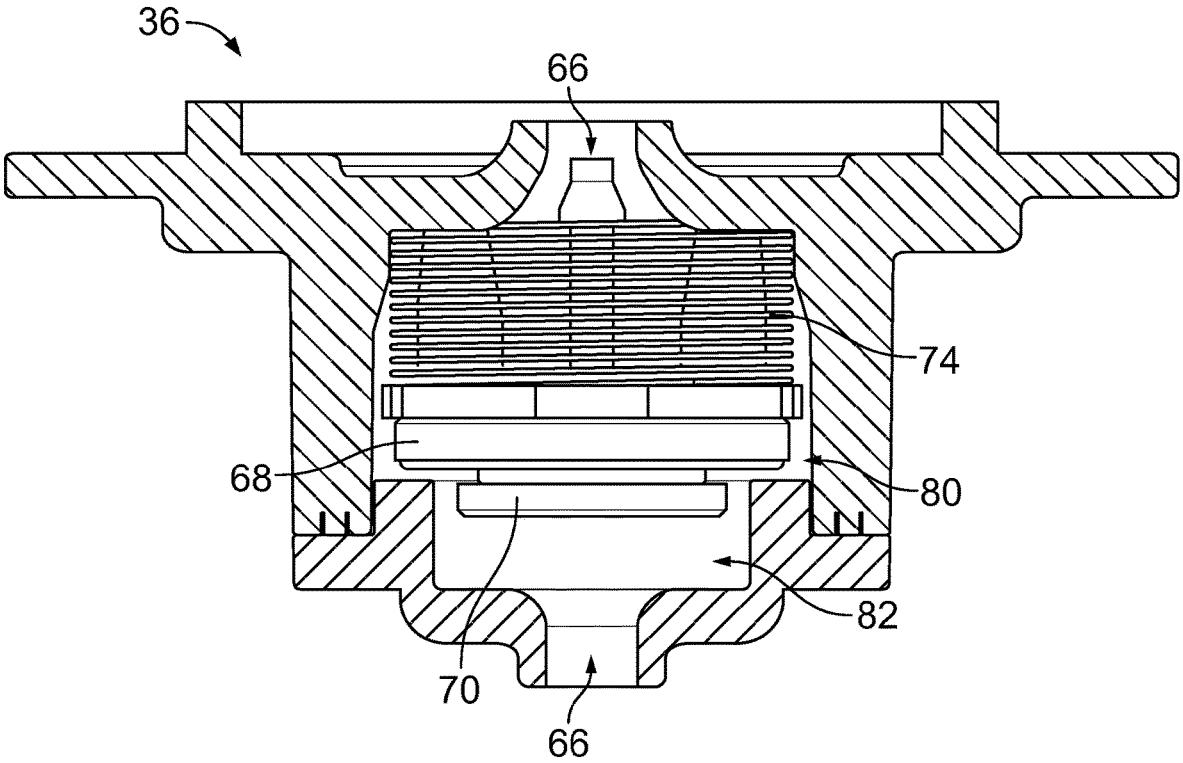
FIG. 11 is a cross sectional view of the valve of FIG. 5, wherein a big door of the valve is in an open configuration.
Figure 12:
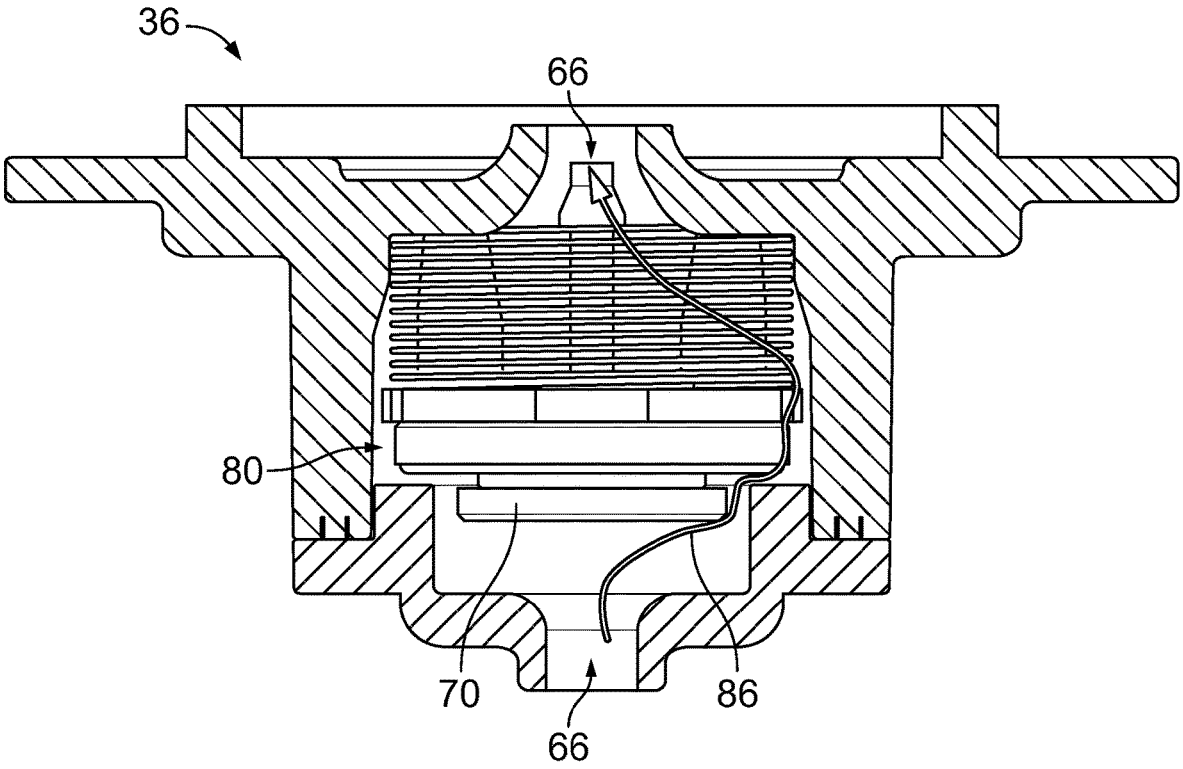
FIG. 12 is a cross sectional view of the valve in FIG. 11, illustrating a positive pressure air flow through the valve.

Conversely, and as illustrated in FIGS. 11 and 12, when the pressure in the fuel system rises above a maximum threshold where the pressure of the fuel system exceeds a pressure of the exterior environment by a predetermined amount, such as during refueling, the positive pressure within the fuel tank will press the big door 68 upwards into the large chamber 80, compressing the big spring 74, and facilitating the positive pressure air flow 86 of air and fuel vapors from the fuel tank through the valve channel 66 and out into the exterior environment. In preferred embodiments, the predetermined amount, or cracking pressure for the maximum threshold, is 7 kPa. When the pressure in the tank is alleviated and drops back below the maximum threshold, the big spring 74 will push the big door 68 back down into the closed configuration.

In a preferred embodiment, the valve body 62 is manufactured as a single unit that is welded or otherwise affixed to the valve cap 64, and that defines internal spaces including the large chamber 80 and recess chamber 82. Internal components of the valve such as the big door 68, small door 70, door seal 72, big spring 74, small spring 76, and valve rod 78, are contained within the large chamber 80 and recess chamber 82. In preferred embodiments, the valve body 62, valve cap 64, big door 68, small door 70, and valve rod 78 are composed of a thermoplastic such as polyoxymethylene, or acetal. In other embodiments, the valve body 62, valve cap 64, big door 68, small door 70, and valve rod 78 are preferably composed of stiff nylon, or glass filled nylon. However, other strong, stiff, and corrosion resistant materials such as stainless steel are also anticipated. Likewise, the small spring 76 and big spring 74 are preferably composed of stainless steel. The valve seal 60, and door seal 72 are preferably composed of a flexible, elastomeric material such as fluoroelastomers produced by Viton™, or nitrile butadiene (NBR) rubbers.

The valve seal 60, as illustrated in FIG. 5, functions as an air seal to prevent passage of air and/or fuel vapors in or out of the fuel system when both the small door 70 and big door 68 of the single pressure regulating valve 36 is in the closed configuration. The valve seal 60 also functions as a flexible rubber joint that allows movement of the single pressure regulating valve 36 when closing the fuel cap 30. This rubber joint further acts as a biasing means or spring to equalize forces exerted upon the single pressure regulating valve 36 when closing the fuel cap 30, allowing for a smaller closing force, thereby making it easier to close the fuel cap 30. In preferred embodiments, the closing force necessary to close the fuel cap is less than 3 lbs. In some embodiments, the biasing nature of the valve seal 60 is facilitated by the plurality of stabilizing towers or detents. The flexibility and elastic nature of valve seal 60 further allows for a higher manufacturing tolerance, durability, and robustness.

Figure 13:
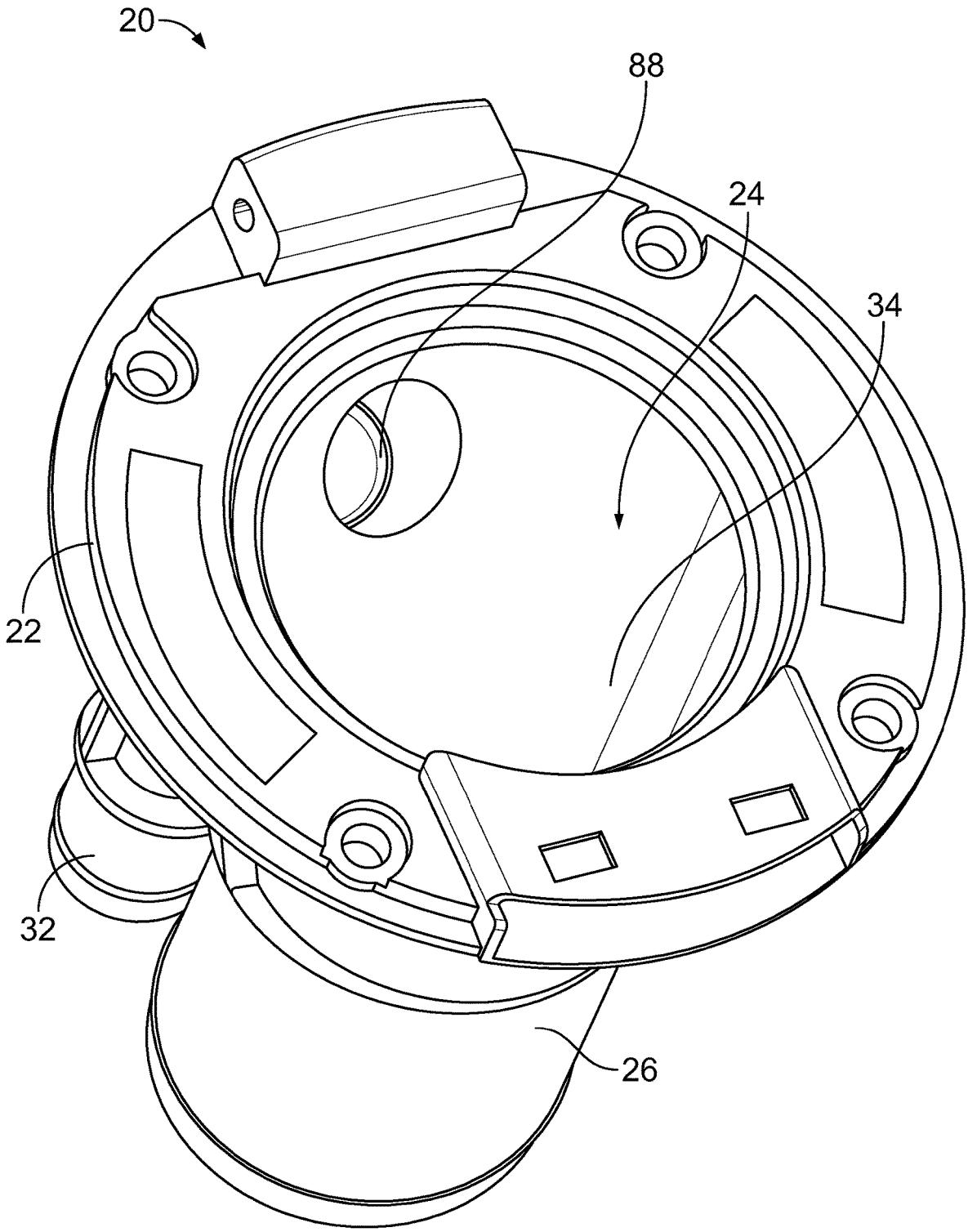
FIG. 13 is a perspective top view of a vented deck fill provided in accordance with an embodiment of the current disclosure.
Figure 14:
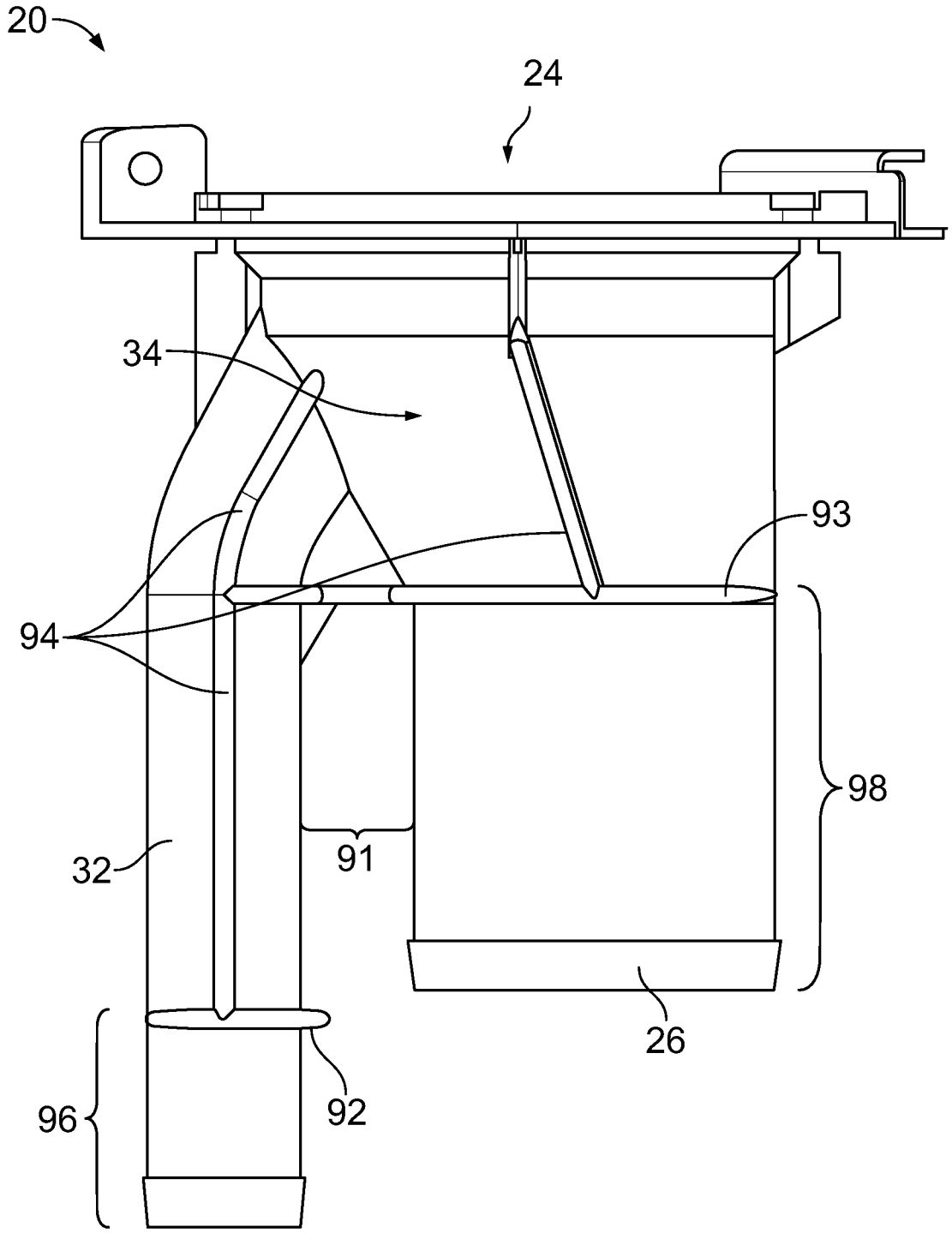
FIG. 14 is a perspective side view of the vented deck fill of FIG. 13.

FIGS. 13 and 14 are perspective views of the vented deck fill 20. In preferred embodiments, the vent throat 32 extends from the body 22 of the vented deck fill 20 near the mouth 24. FIG. 13 is a top perspective view of a vented deck fill 10 illustrating a vent throat entrance 88 as seen through the mouth 24. As illustrated in FIG. 14, in preferred embodiments, the vent throat 32 extends away from the atrium 34 before turning to run parallel to the fuel throat 26, defining a gap 91 between the vent throat 32 and the fuel throat 26. The fuel throat 26 and vent throat 32 further define a distal vent end 96 and a distal fuel end 98, respectively. Some embodiments further include a vent throat ring or ridge 92 marking the distal vent end 96, and a fuel throat ring or ridge 93 marking the distal fuel end 98. Moreover, some embodiments additionally include a plurality of exterior ribs 94 along the fuel throat length 27 and a plurality of exterior ribs 94 along the vent throat length 31.

Figure 15:
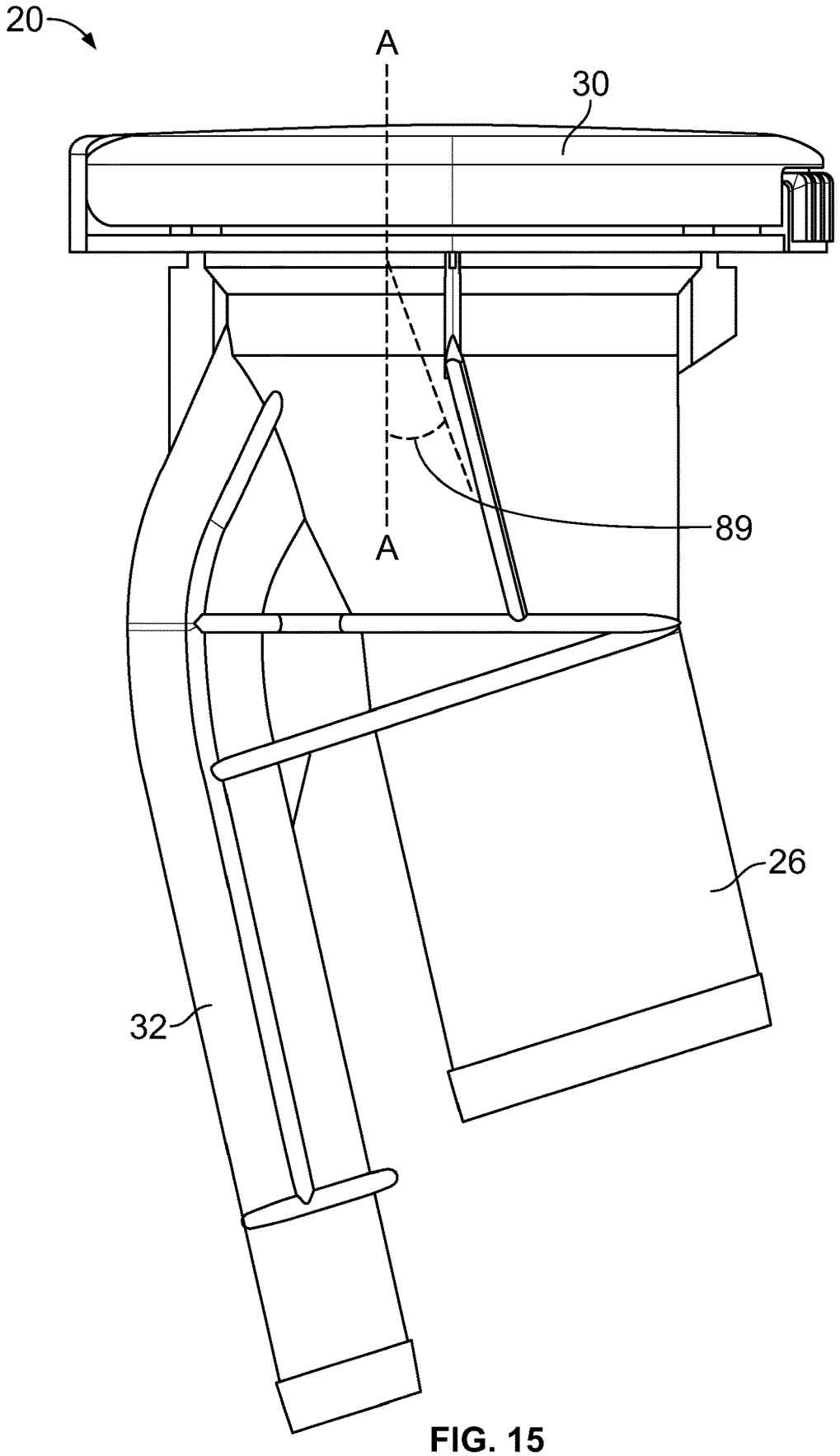
FIG. 15 is a perspective side view of a vented deck fill provided in accordance with an embodiment of the current disclosure, wherein a fuel throat and vent throat extend from an axis A-A at a 33° angle.

As further illustrated in FIG. 15, in some embodiments, the fuel throat 26 extends downward at a vented deck fill angle 89 relative to axis A-A perpendicular to the mouth 24 to accommodate insertion of the fuel nozzle. In a preferred embodiment, the fuel throat 26, and correspondingly the vent throat 32, extend at a 33-degree angle 89. See FIG. 15. However, other angles 89 of both fuel throat 14 and vent throat 22 are anticipated, preferably ranging from 30-35-degrees, to match the possible angle of fuel pump nozzles.

Figure 16:
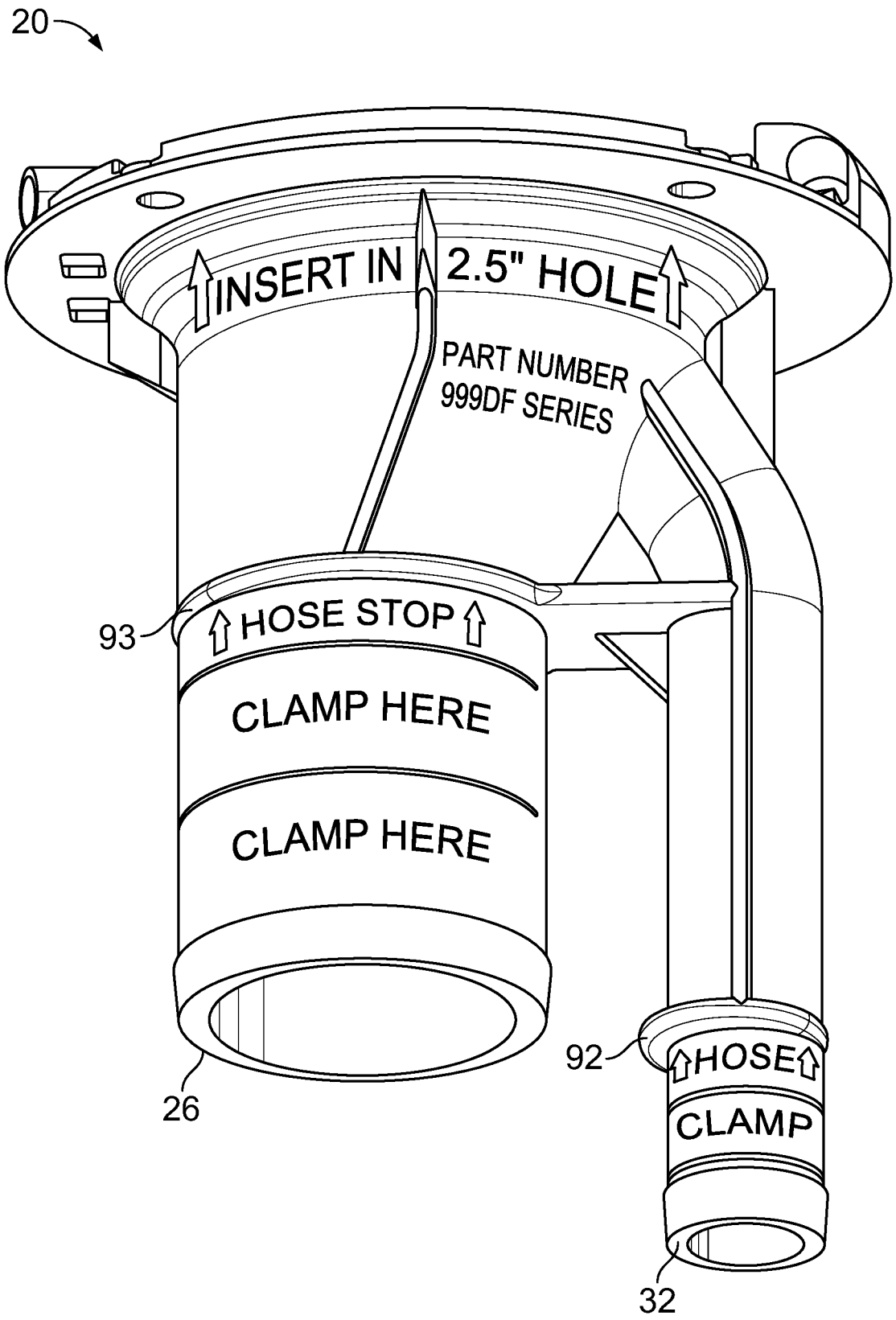
FIG. 16 is a perspective view of a vented deck fill provided in accordance with embodiment of the current disclosure, in which installation instructions or guidance are printed, etched, or otherwise marked on the body of the deck fill.

In some embodiments, as illustrated in FIG. 16, the vented deck fill 20 may contain lettering on an external surface that provides instructions for installation. For instance, in some embodiments, the vented deck fill 20 may have the words "clamp here" or "hose stop" printed, etched, engraved, or otherwise marked on the vent throat 32 or fuel throat 26, thereby providing an installer information on where to apply clamps that hold a vent hose to the vent throat 32 and the fuel hose to the fuel throat 26. Other words and instructions are contemplated by this disclosure and those illustrated in FIG. 16 merely exemplification of the instruction method contemplated therein. Similarly, it is anticipated that instructions related to hole installation may be printed, etched, engraved, or otherwise marked on the body 22 of the vented deck fill 20. For instance, in some embodiments the words "insert in 2.5" hole" may be marked on the vented deck fill 20. Again, other instructional language or symbols are contemplated.

Figure 17A:
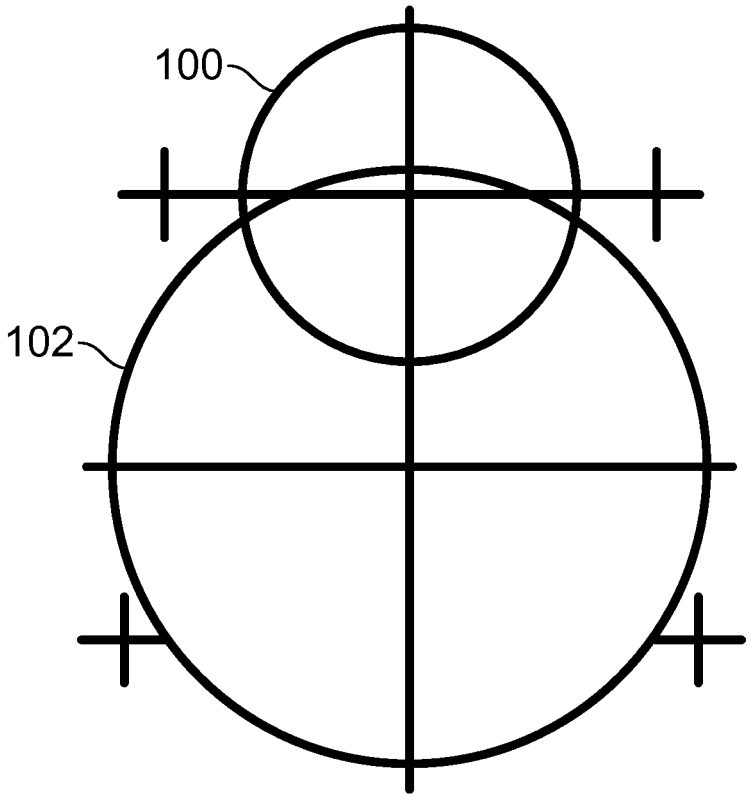
FIG. 17A (Prior Art)
FIG. 17*a* is a schematic of a drill pattern for a two-hole installation of a vented deck fill provided in accordance with the prior art.

In accordance with the prior art, as shown in FIG. 17*a*, installation of a vented deck fill generally utilizes a two-hole method, where a user drills a small hole 100 for a vent throat and a large hole 102 for a fuel throat. FIG. 17*a* is a schematic illustrating the traditional pattern for drilling the two holes. As seen in the schematic, the two holes often overlap. This is done because the vent throat and fuel throat of the prior art deck fills have to be close enough together that the two installation holes are covered by a deck fill flange and a fuel cap. Common flange sizes for vented deck fills are typically between 80 mm and 88 mm, and most flange sizes are 84 mm in diameter. The small hole 100 is typically drilled first. In a traditional pattern, the center of the small hole 100 overlaps within the space of the large hole 102. Thus, if the large hole 102 is drilled first, there is no material for a center of a drill bit to dig into to drill the small hole 100 (i.e., the center of the small hole 100 is located within a void created by the large hole 102), making installation of the small hole 100 nearly impossible. However, even if the small hole 100 is drilled first, the two-hole installation method is still difficult, requiring detailed templates, and exact drilling for both holes to facilitate an appropriate fit for the deck fill. The requisite drilling of two separate holes, in precise positional relation to each other, also increases the risk that mistakes will be made during installation. Such mistakes can be costly, considering the expense of installation of boat hulls and decks. Conversely, installation using a single hole method only requires drilling a single hole, cutting down on time, effort, and the possibility of costly mistakes.

Figure 17B:
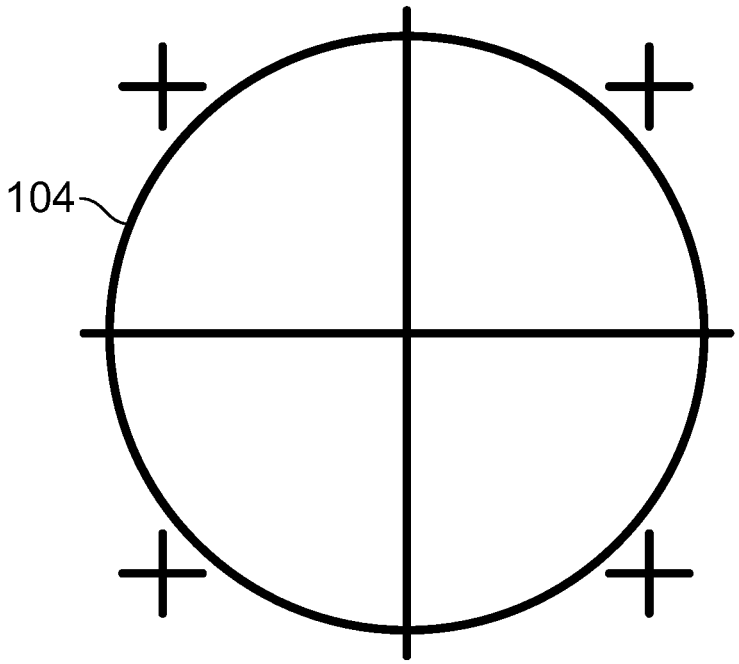
FIG. 17*b* is a schematic of a drill pattern for a single hole installation of a vented deck fill provided in accordance with an embodiment of the current disclosure.

FIG. 17*b* is a schematic illustrating a drill pattern utilized in a single-hole 104 installation method provided in accordance with an embodiment of the current disclosure. The installation method includes the steps of drilling a single hole 104 into a deck or hull of the marine vehicle and inserting a vented deck fill 20 such that the vent throat 32 and fuel throat 26 extend through the single hole 104 and the flange 28 sits on an outside of the single hole 104.

Figure 18:
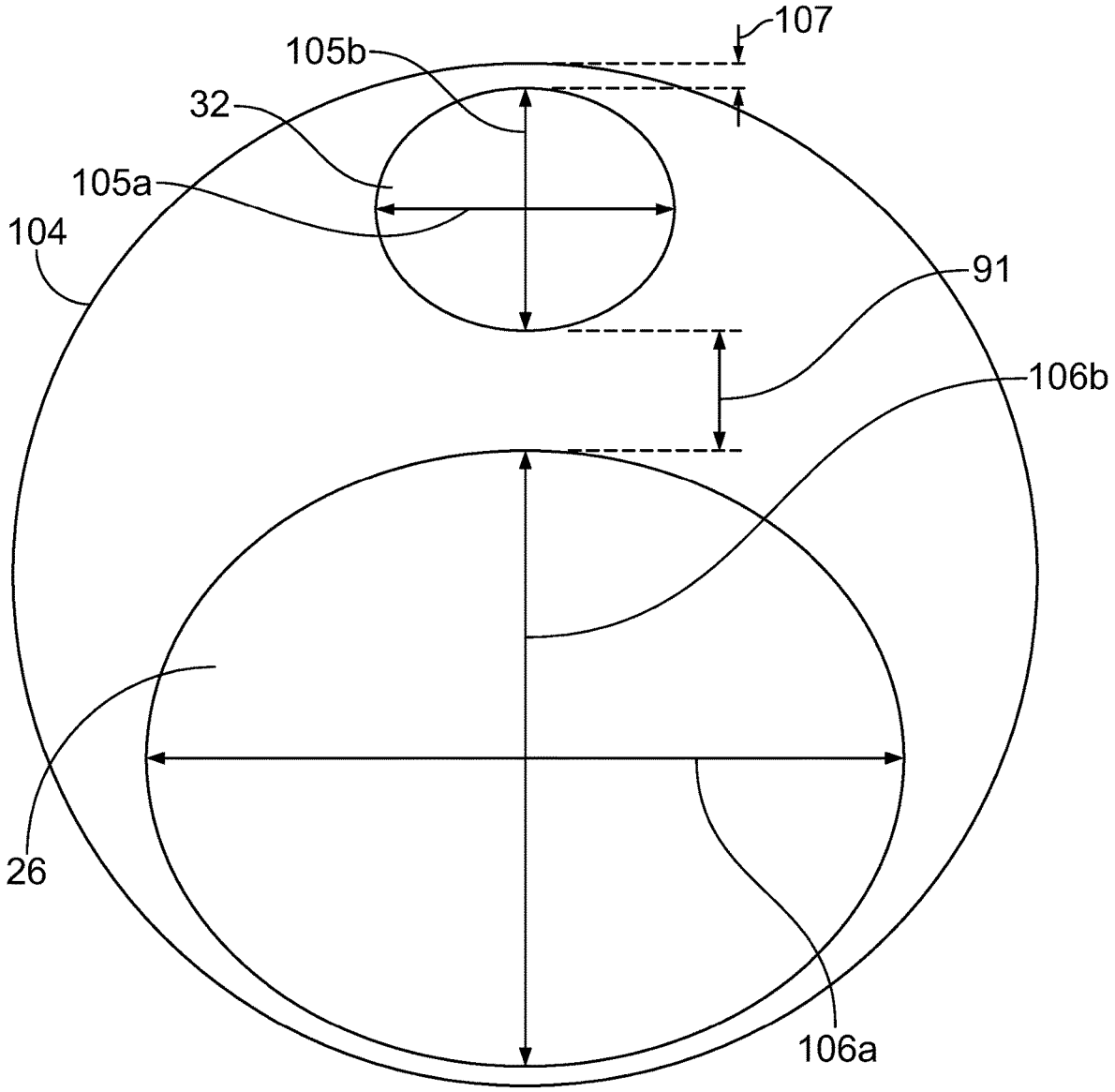
FIG. 18 is a schematic illustrating the placement of a fuel throat and a vent throat of a vented deck fill within the single hole of FIG. 17*b*.
Figure 19A:
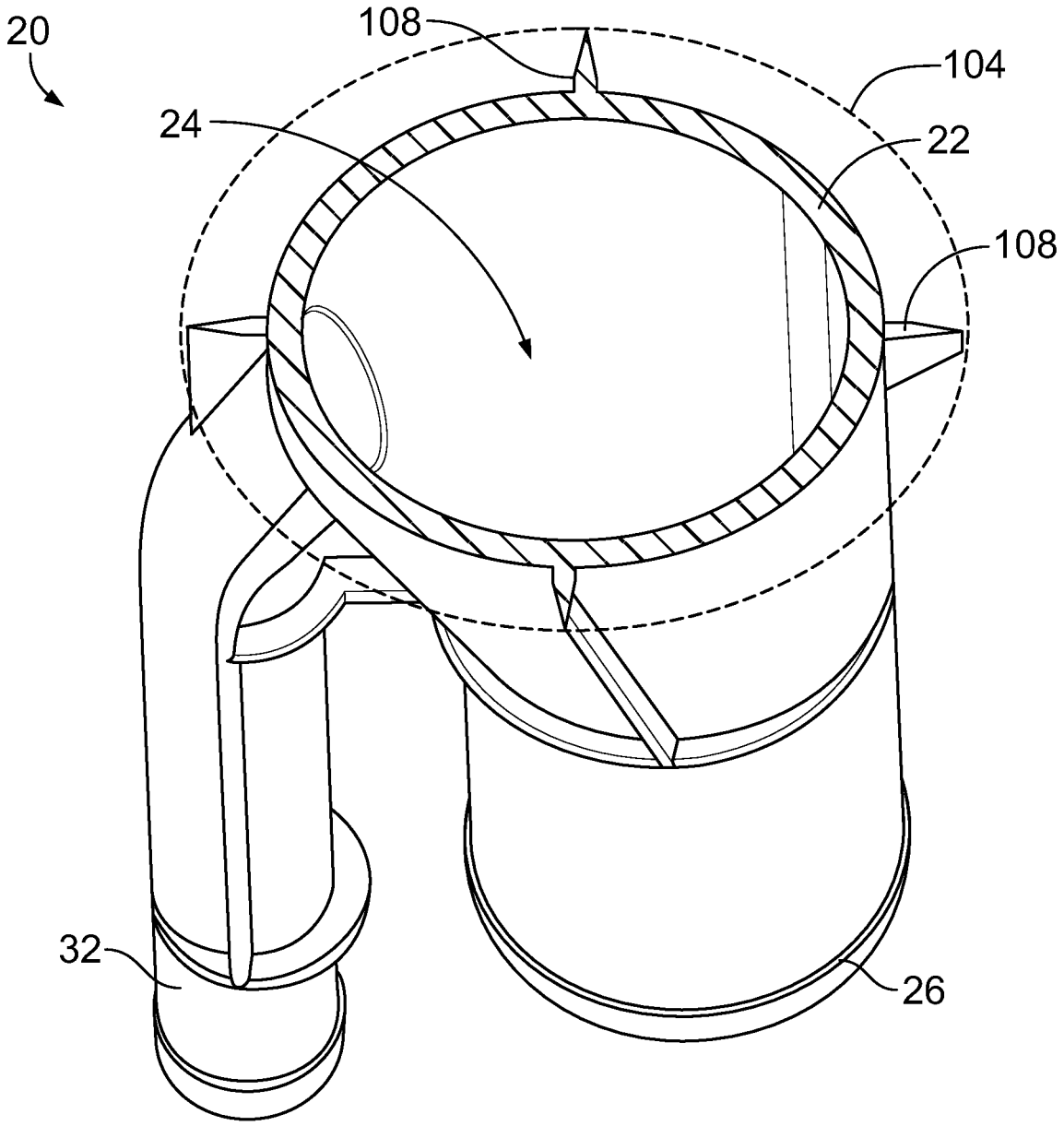
FIG. 19*a*. is a perspective view of a vented deck fill comprising a plurality of centering ribs provided in accordance with an embodiment of the current disclosure.
Figure 19B:
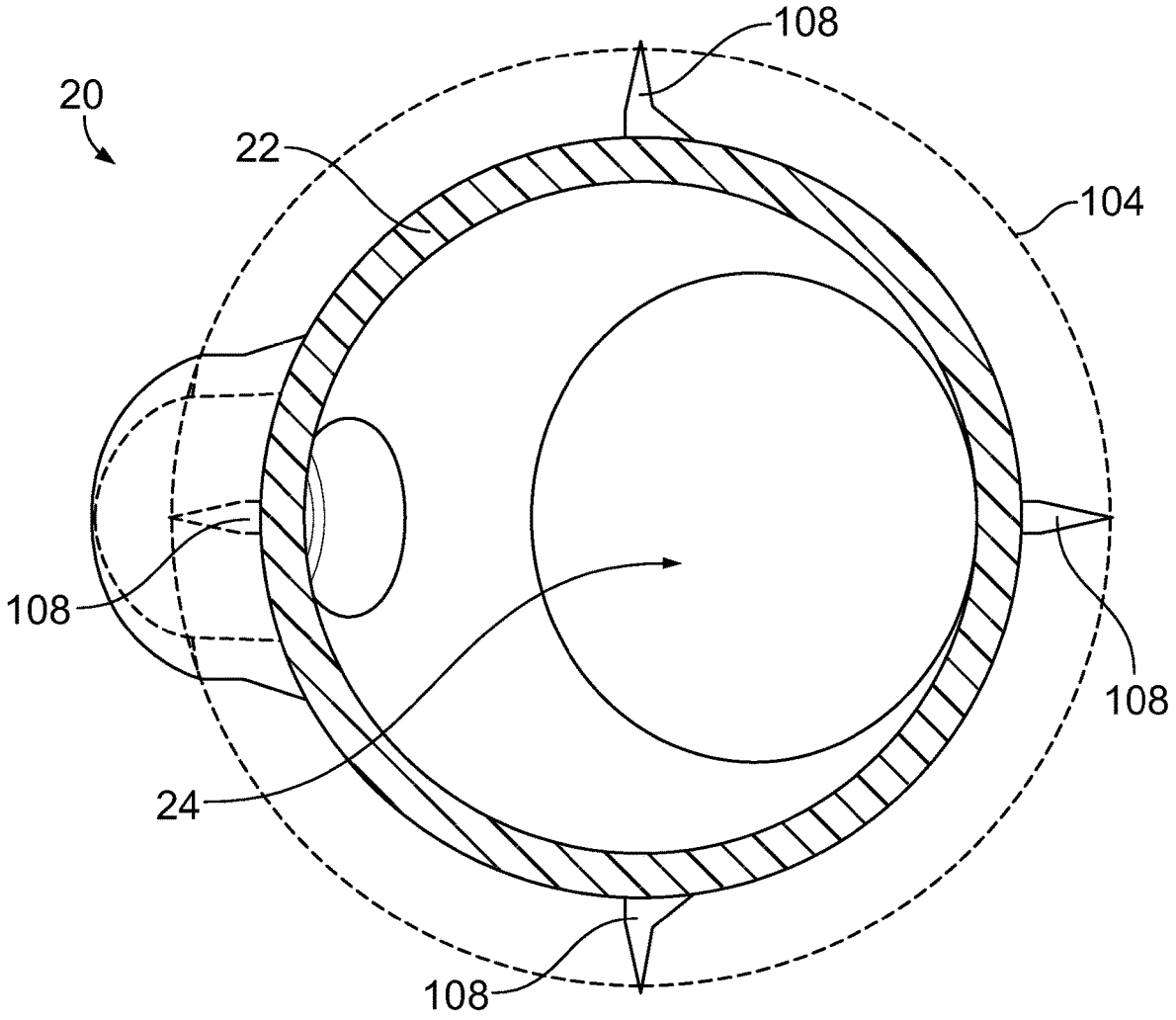
FIG. 19*b* is a top perspective view of the vented deck fill of FIG. 19*a*.

FIGS. 18, 19*a*, and 19*b* illustrate the placement of the fuel throat 26 and the vent throat 32 within the single hole 104. To rectify the difficulties presented with the two-hole installation method of the prior art, some embodiments of the present disclosure utilize a vented deck fill 20 where the fuel throat 26 and vent throat 32 define a void therethrough having elliptical circumferences along at least a majority of the fuel throat and vent throat lengths 27, 31 as illustrated in FIG. 18. Generally, in the prior art, the fuel throat and vent throat define pipes with circular circumferences, resulting in a 14 mm gap 91 between the fuel throat and vent throat. In preferred embodiments, the gap 91 has a length that is less than 20% of the outer throat diameter 35. By providing the vented deck fill 20 that features an elliptical fuel throat 26 and elliptical vent throat 32, the preferred embodiment of the current disclosure facilitates a gap 91 that is less than 14 mm. In a preferred embodiment, a vent throat major diameter 105*a* is 16.33 mm, while a vent throat minor diameter 105*b* is 15.33 mm. In one embodiment, a fuel throat major diameter 106*a* is 39.15 mm while a fuel throat minor diameter 106*b* is 36.5 mm. This facilitates reduction of the gap 91 to under 12 mm and allows installation of the vented deck fill 20 within a 63.5 mm diameter single hole 104, while still providing 0.1 mm clearance 107 between the fuel throat 26 or vent throat 32 and an edge of the single hole 104. Thus, the preferred embodiment can be covered by a typical 84 mm flange 28. However, other hole 104 sizes, flange 28 sizes, fuel throat 26 and vent throat 32 dimensions, and gap 91 distances are contemplated by this disclosure. For instance, it is contemplated that the flange 28 may have a diameter between 67.2 mm and 100.8 mm. In such embodiments, it is anticipated that the vent throat major diameter 105*a* is between 13.06 mm and 19.59 mm and the vent throat minor diameter 105*b* is between 12.24 mm and 18.39 mm. It is further anticipated that in such embodiments the fuel throat major diameter 106*a* is between 31.32 mm and 46.98 mm and the fuel throat minor diameter 160*b* between 29.2 mm and 43.8 mm. Gaps 91 between 11.2 mm and 14 mm are also contemplated by this disclosure.

As illustrated in FIGS. 19*a* and 19*b*, some embodiments further include a plurality of centering ribs 108 extending radially from the body 22 of the vented deck fill 20. These centering ribs 108 extend outward from the body 22 defining the mouth 24 of the deck fill 20 and facilitates a more consistent and repeatable dimensional certainty when installing the vented deck fill 20, thereby allowing smaller clearance for mounting screws and further reducing the necessary hole size 104 for installation.

As illustrated in FIGS. 14-16, in some embodiments the vent throat 32 is longer than the fuel throat 26. This further enables the reduction of the gap 91 and thereby facilitates installation utilizing the single hole 104 method. During installation, the fuel hose preferably encases the distal fuel end 98 of the fuel throat 26, and the vent hose encases the distal vent end 96 of the vent throat 32. The fuel hose and vent hose are then preferably held in place by worm gear clamps. However, other clamps and methods for affixing the hoses to the throats 26 and 32 are also contemplated by this disclosure. When the vent throat 32 extends beyond the fuel throat 26, the worm gear clamps can be staggered such that the worm gear clamps on the fuel throat 26 are higher up and closer to the mouth 24 than the clamps on the vent throat 32. Conversely, this disclosure also contemplates embodiments in which the fuel throat 26 extends beyond the vent throat 32. In traditional deck fills, the gap between the vent throat and fuel throat needs to account for the dimensions of clamps that are adjacent, rather than staggered. Here though, the staggered clamps allow for a smaller gap 91 between the vent throat 32 and the fuel throat 26, allowing for easier installation of the deck fill 20 using a single hole 104 method.

As further illustrated in FIG. 14, some embodiments additionally include the vent throat ring 92 around the vent throat 32 and/or the fuel throat ring 93 around fuel throat 26. The vent throat ring 92 stops the insertion of the vent hose onto the vent throat 32 at a predetermined location, with the vent throat ring 92 acting as a physical barrier. Similarly, the fuel throat ring 93 stops the insertion of a fuel hose onto the fuel throat 26 at a predetermined location. In other words, the vent throat ring 92 and/or a fuel throat ring 93 prohibit the insertion of the vent throat 32 and/or fuel throat 26 into an associated vent hose and/or fuel hose beyond a location of the vent throat ring 93 and the fuel throat ring 92, thereby marking an ideal installation position for the vent hose and fuel hose. Thus, the ring 92 informs an installer when the throat 26 or 32 is all the way into the hose. This assists the installer in staggering the worm gear clamps in appropriate positions. Some embodiments comprise both the fuel throat ring 93 and the vent throat ring 92, while others comprise one but not both rings 92, 93, and others comprise no rings 92, 93 at all.

FIG. 14 further illustrates some embodiments of deck fills 20 in which the plurality of exterior ribs 94, or load paths, provide structural stability and strength. In preferred embodiments, these exterior ribs 94 add geometrical strength in unconstrained locations of the deck fill 20.

Figure 23:
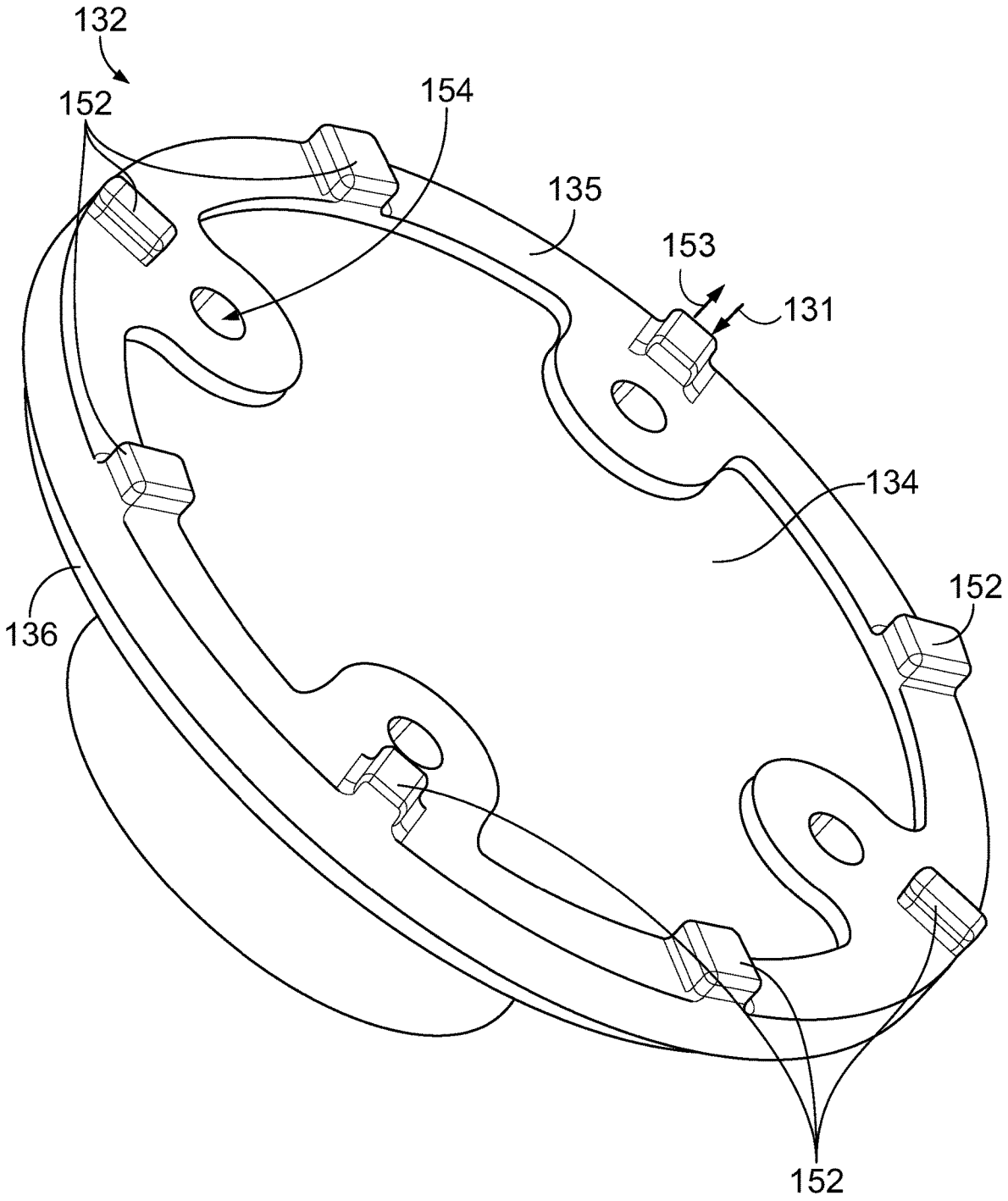
FIG. 23 is a perspective view of a floating puck assembly provided in accordance with an embodiment of the current disclosure.
Figure 24:
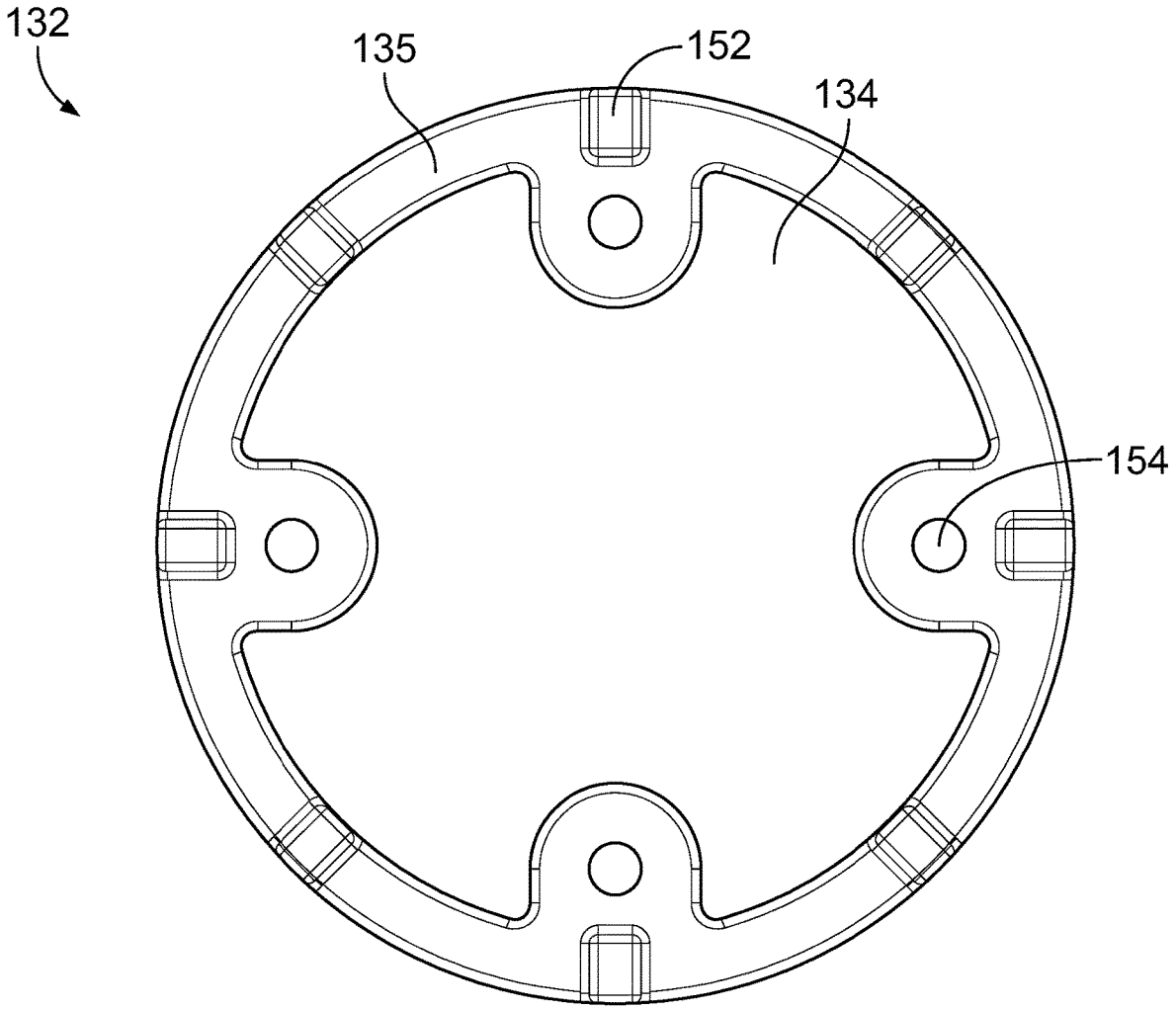
FIG. 24 is a perspective top view of the floating puck assembly of FIG. 23
Figure 25:
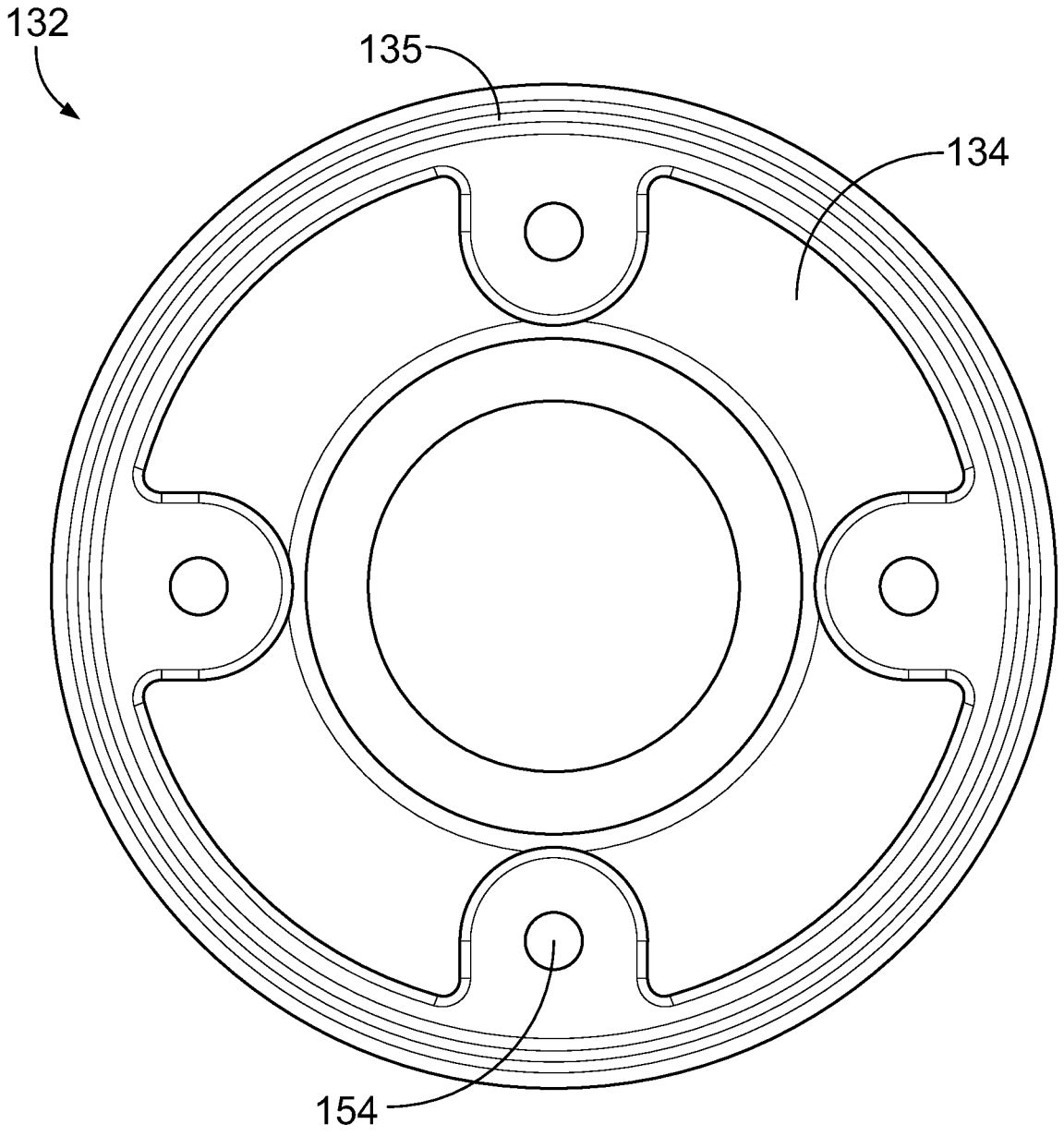
FIG. 25 is a perspective bottom view of the floating puck assembly of FIG. 23.
Figure 26:
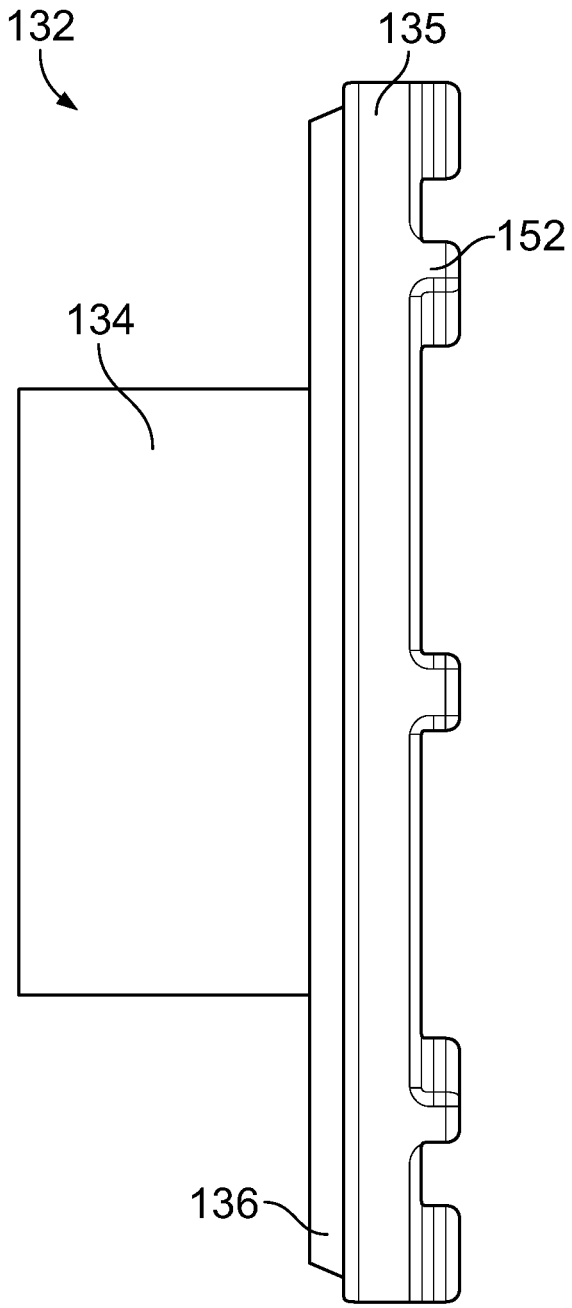
FIG. 26 is a perspective side view of the floating puck assembly of FIG. 23.

FIG. 20 is a perspective view of a non-vented deck fill 120 provided in accordance with an embodiment of the current disclosure. FIG. 21 is a cross sectional view of the non-vented deck fill 120 and FIG. 22 is an exploded view of the non-vented deck fill 120. In addition to the body 122, mouth 124, fuel throat 126, flange 128, and fuel cap 130, preferred embodiments additionally comprise a floating puck assembly, or puck 132 that is fastened to the fuel cap 130. As shown in FIG. 21, in some embodiments of the non-vented deck fill 120, the fuel throat 126 extends downward at a non-vented deck fill angle 189 relative to axis B-B, where axis B-B is perpendicular to the mouth 124, to accommodate insertion of the fuel nozzle. In a preferred embodiment, the non-vented deck fill angle 189 is 33-degrees. However, other preferred embodiments have non-vented deck fill angles 189 between 30 and 35-degrees. The non-vented deck fill 120 may be fastened to the deck 33 by passing one or more deck screws through complementary holes in the flange 128. FIGS. 21 and 23 further illustrate a closing force 131 that the fuel cap 130 exerts upon the puck 132 when a user closes the fuel cap 130.

As illustrated in FIG. 22, the puck 132 is preferably held in place with a plurality of puck screws 133. In a preferred embodiment, the puck 132 is held in place with four screws 133. In another embodiment, the puck is held in place with two screws 133. However, use of a different number of screws or other fastening method is contemplated. FIG. 22 also illustrates components of a push button assembly 138 and a hinge clearance scallop 140. The push button assembly comprises a push button 142, a compression spring 144, and a button housing 146. The hinge clearance scallop 140 comprises a hinge pin 148 and a torsion spring 150.

As illustrated in FIGS. 23-26, the puck 132 preferably includes a puck body 134 crowned with a mounting pad 135, and in some embodiments, a plurality of towers or detents 152. A plurality of puck screw holes 154 extend through the puck body 134 and mounting pad 135 in embodiments where the puck 132 is screwed to the fuel cap 130 by the plurality of puck screws 133. The mounting pad 135 additionally comprises a sealing ring 136. In some embodiments the puck body 134 is composed of a polymer such as plastic, and the mounting pad 135 and sealing ring 136 are made of an elastomeric material such as rubber. In preferred embodiments, the puck body 134 is composed of a thermoplastic such as polyoxymethylene, or acetal. In other embodiments, the puck body 134 is instead composed of stiff nylon, or glass filled nylon. However, other strong, stiff, and corrosion resistant materials such as stainless steel are also anticipated. The mounting pad 135 and sealing ring 136 are preferably composed of a flexible, elastomeric material such as fluoroelastomers produced by Viton™ or nitrile butadiene (NBR) rubbers.

The mounting pad 135 functions as a flexible rubber joint that allows movement of the puck 132 when closing the fuel cap 130. The rubber joint further acts as a biasing means or spring to equalize forces exerted upon the puck 132 when closing the fuel cap 130, allowing for a smaller closing force, thereby making it easier to close the fuel cap 130. In some embodiments, the biasing nature of the mounting pad 135 is facilitated by the plurality of stabilizing towers or detents 152. When the closing force 131 is applied to the fuel cap toward the flange 128, the mounting pad 135 and/or detents 152 exert an equalizing force 153 to the floating puck assembly 132 in an amount corresponding to the closing force 131. In other words, the mounting pad 135 and/or detents 152 balance the closing force 131, but do not exert a force greater than the closing force 131 that would prevent a user from closing the fuel cap 130. The flexibility and elastic nature of the mounting pad 135 further allows for a higher manufacturing tolerance, durability, and robustness.

Figure 27:
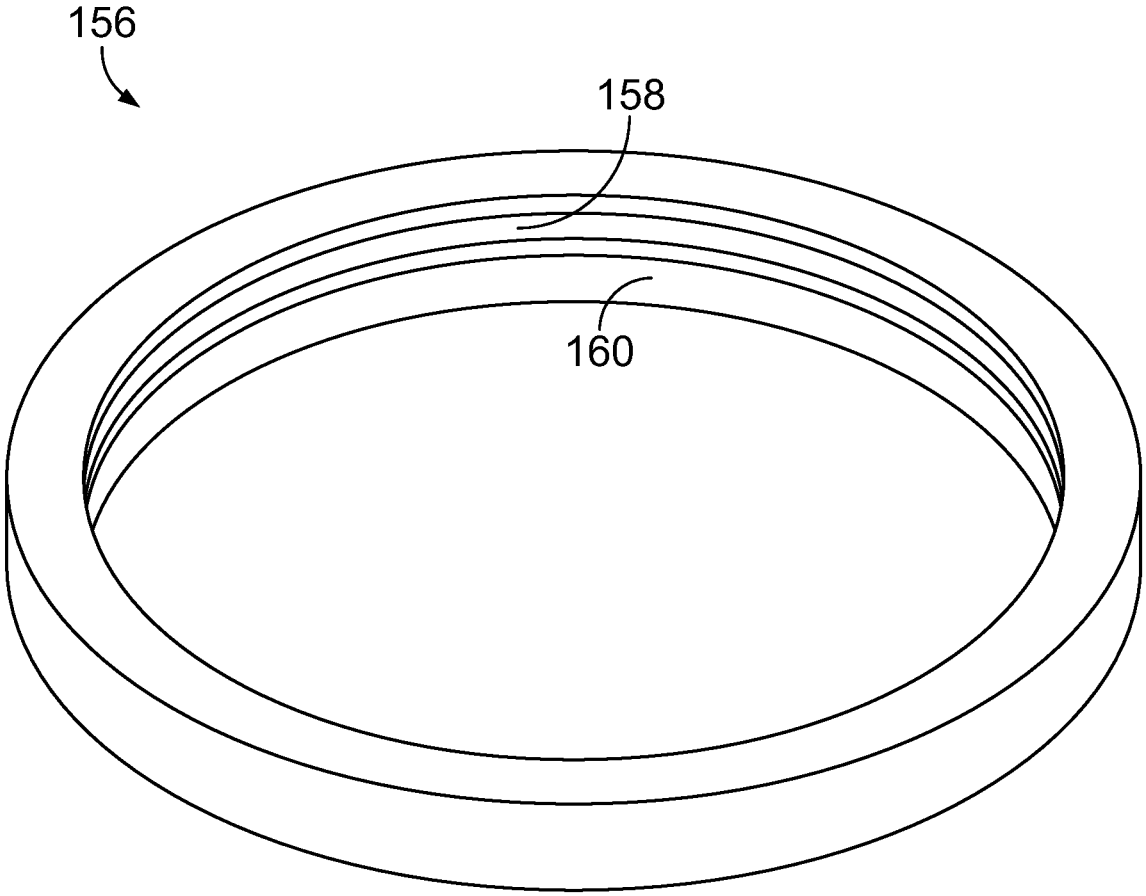
FIG. 27 is a perspective view of an E-seal gasket in accordance with an embodiment of the current disclosure.
Figure 28:
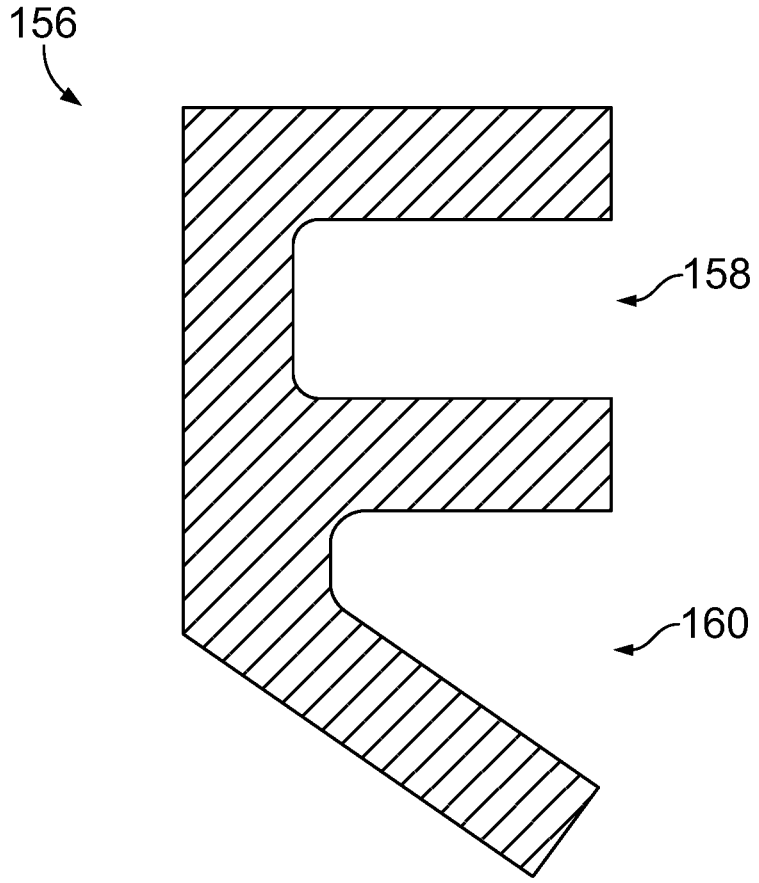
FIG. 28 is a cross sectional view of the E-seal gasket of FIG. 27.
Figure 29:
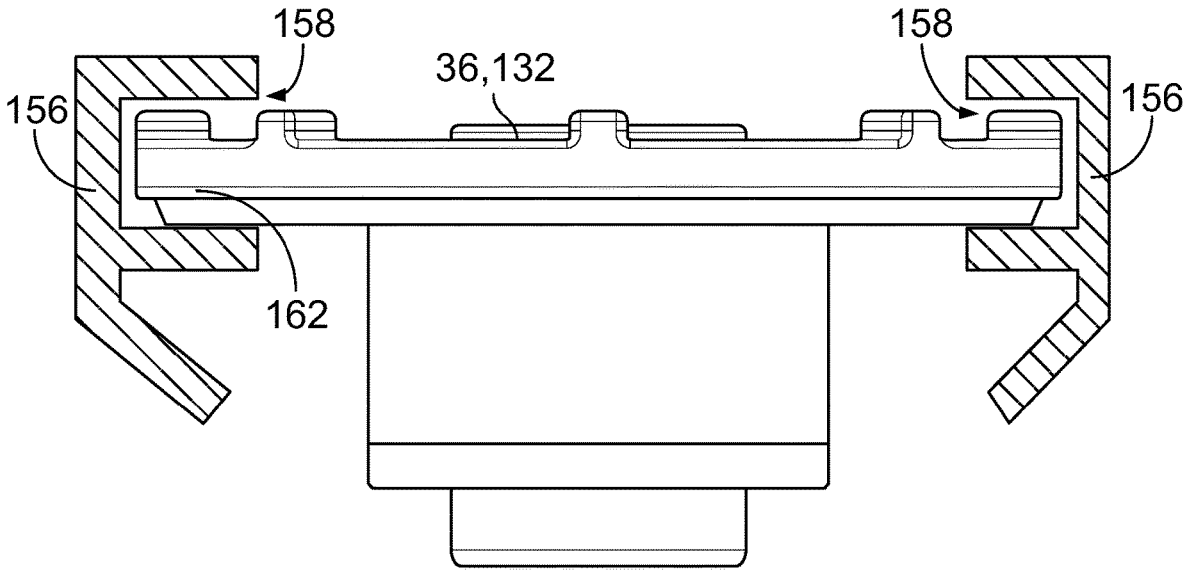
FIG. 29 is a perspective and cross-sectional view of the E-seal gasket of FIG. 27 as it fits on a floating puck or single pressure regulating valve in accordance with embodiments of the current disclosure.

FIGS. 27-29 illustrate an alternative mounting system, utilizing a gasket 156 for the puck 132 or single pressure regulating valve 36 in non-vented 120 and vented deck fills 20 respectively. In preferred embodiments, the gasket 156 defines an E-seal, wherein the gasket 156 defines an upper channel 158 and a lower channel 160. See FIG. 27. As illustrated in FIG. 29, in preferred embodiments, the gasket 156 (shown as a cross section) stretches around the puck 132 or valve 36 such that a top cap 162 of the puck 132 or valve 36 inserts into the upper channel 158.

In embodiments utilizing the gasket 156, the gasket 156 takes the place of the valve seal 60, or mounting pad 135 and detents 152, in embodiments utilizing the single pressure regulating valve 36 or floating puck 132 respectively. As such, the gasket 156 is preferably formed of a flexible elastomeric material such as fluoroelastomers produced Viton™ or NBR rubber. In preferred embodiments utilizing the gasket 156, the pressure regulating valve 36 or floating puck 132 are fixed to the fuel cap 30, 130, by two hard screws.

To work effectively, the gasket 156 must create a seal between a fuel system atmosphere and the external atmosphere such that air and/or fuel vapors do not leak out of the fuel system when a pressure of the fuel system atmosphere is less than 10 kPa at temperatures ranging between −40° C. and +80° C. However, typical gaskets 156 are formed of flexible elastomeric materials with a Youngs Modulus between 0.7 MPa and 14.7 MPa and thus has a flexibility that allows the gaskets 156 to flex radially away from the top cap 162 of the puck 132 or valve 36 when subjected to fuel system pressures less than 10 kPa.

Figure 30A:
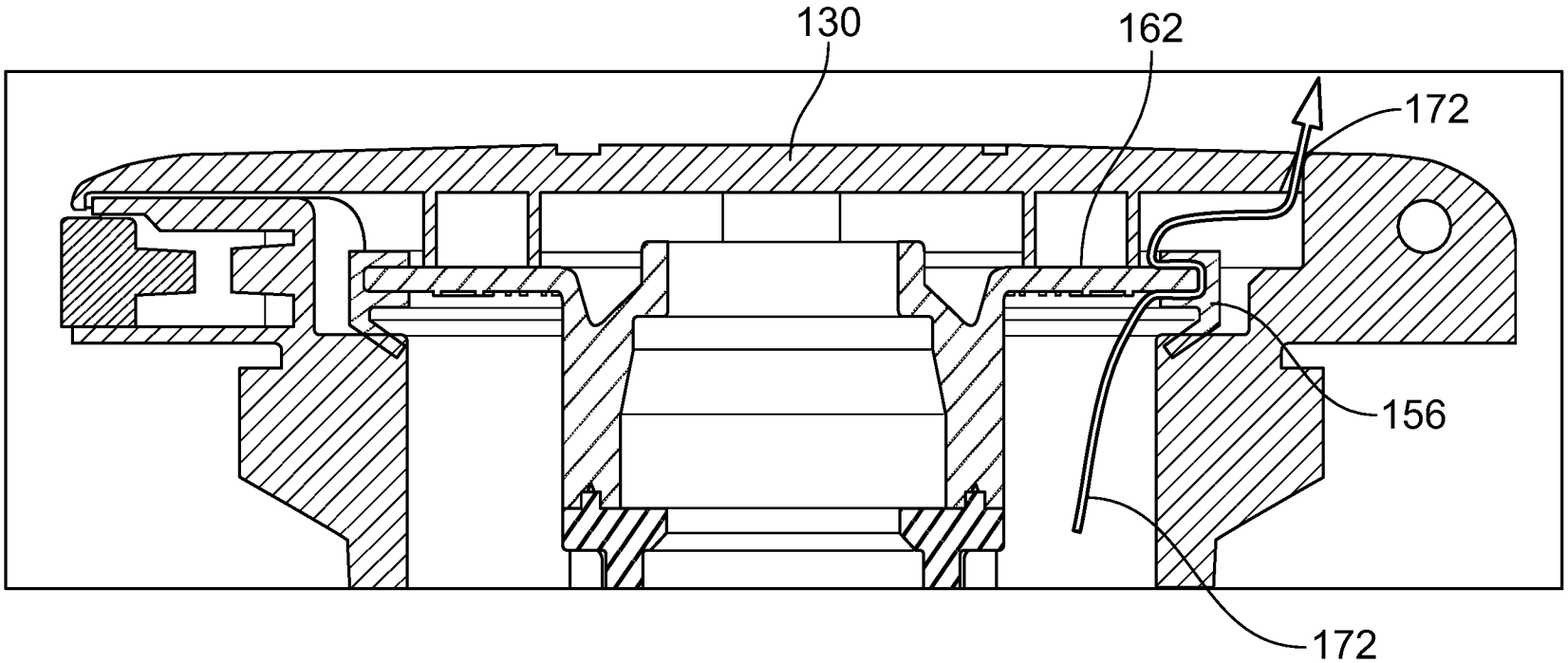
FIG. 30*a* is a cross sectional view of a deck fill, illustrating a leak path, and demonstrating a problem resolved by embodiments of the current disclosure.
Figure 30B:
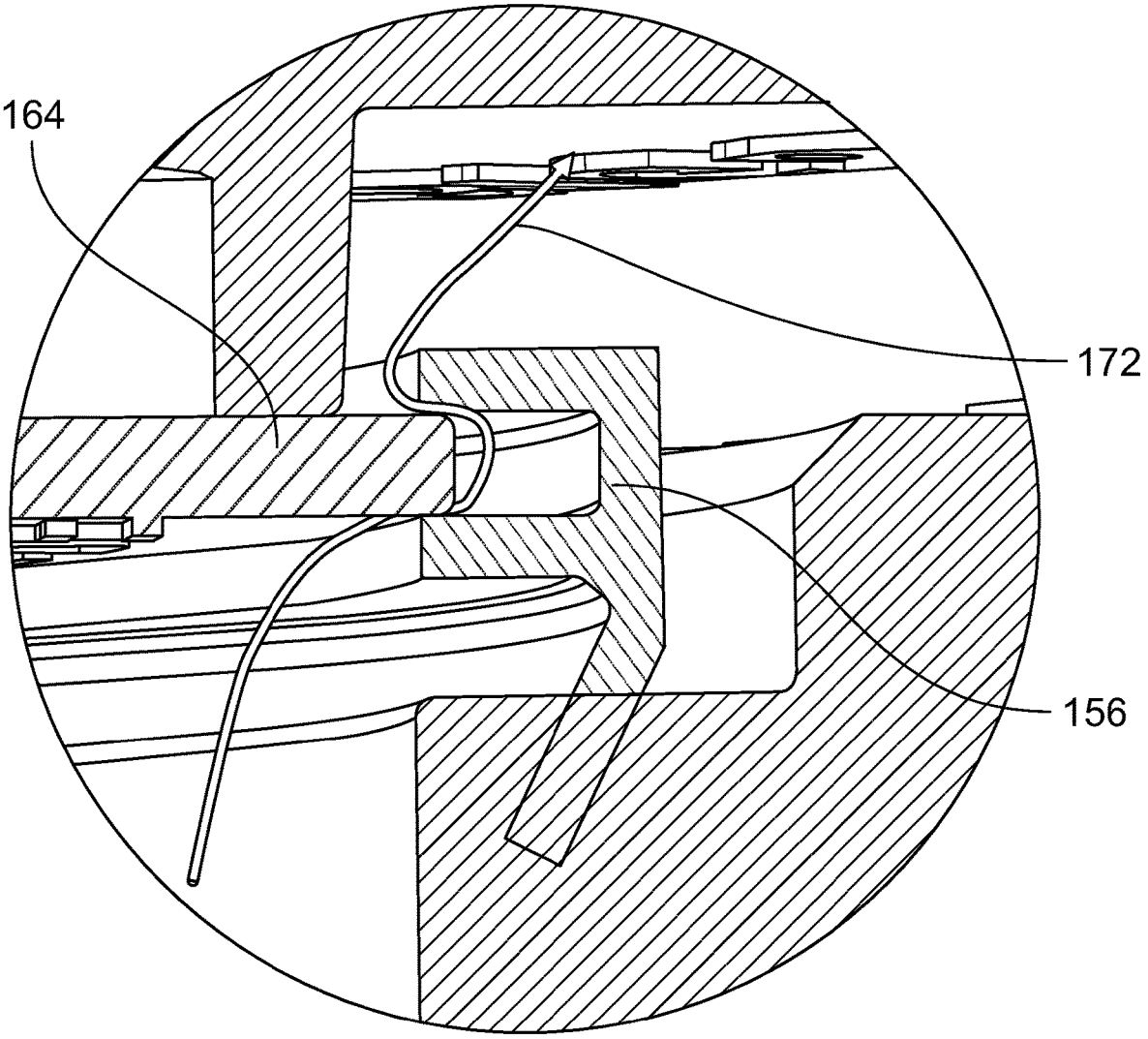
FIG. 30*b* is a close-up view of the cross section of FIG. 30*a*.

Thus, as shown in FIGS. 30*a* and 30*b*, air from within the fuel system can leak out of the fuel system along a leak path 172 at fuel system pressures at or around 8 kPa, at ambient temperatures at or around 23° C. In such instances, the fuel system pressure pushes on the gasket 156, and air can leak around the top cap 162 that is inserted within the upper channel 158, and then around the fuel cap 130 and into the outside atmosphere.

To remedy this issue, in some embodiments, the gasket 156 is made up of an elastomeric material comprised of an elastomeric material with a Youngs Modulus greater than 14.7 MPa and increases the rigidity and Modulus of the seal by up 5 or 10 times that of typical gaskets 156. In preferred embodiments, the gasket 156 is comprised of a fluoroelastomer such as that produced by Viton™, or if NBR rubber.

In other embodiments, a glue or other sealant is used between the gasket 156 and the top cap 162 of the single pressure regulating valve 36 or puck 132. This prevents the gasket 156 from flexing radially away from the top cap 162 and releasing air along the leak path 172.

Figure 31A:
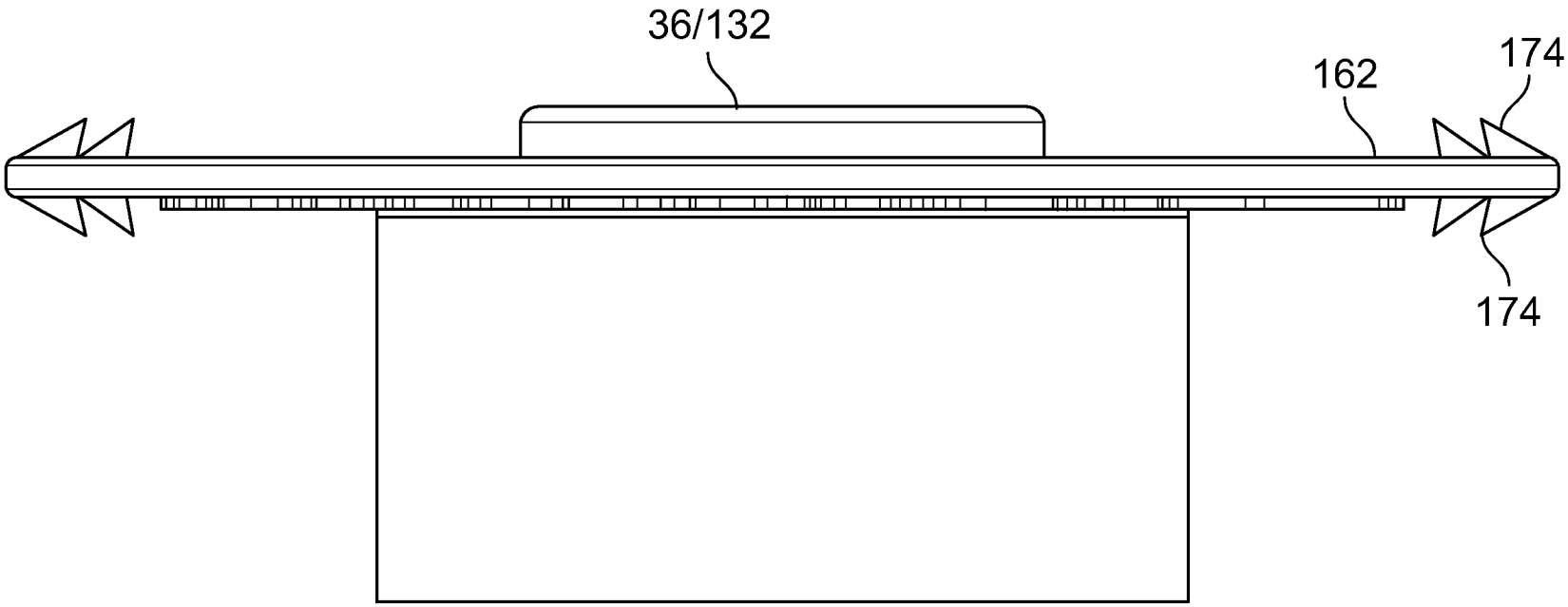
FIG. 31*a* is a perspective side view of a floating puck or single pressure regulating valve comprising a plurality of barbs, in accordance with embodiments of the current disclosure.
Figure 31B:
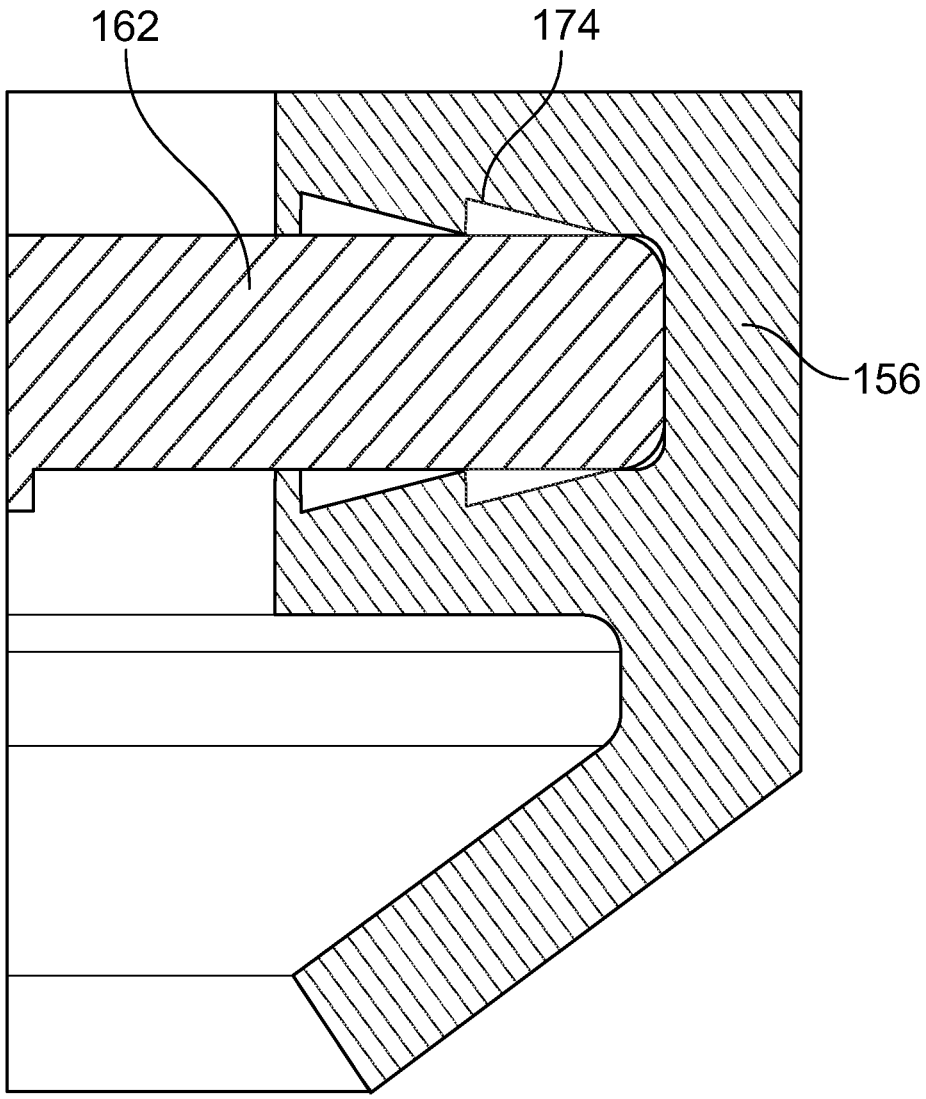
FIG. 31*b* is a cross section view of the floating puck or single pressure regulating valve of FIG. 31*a* in relation to an E-seal gasket, in accordance with embodiments of the current disclosure.
Figure 32:
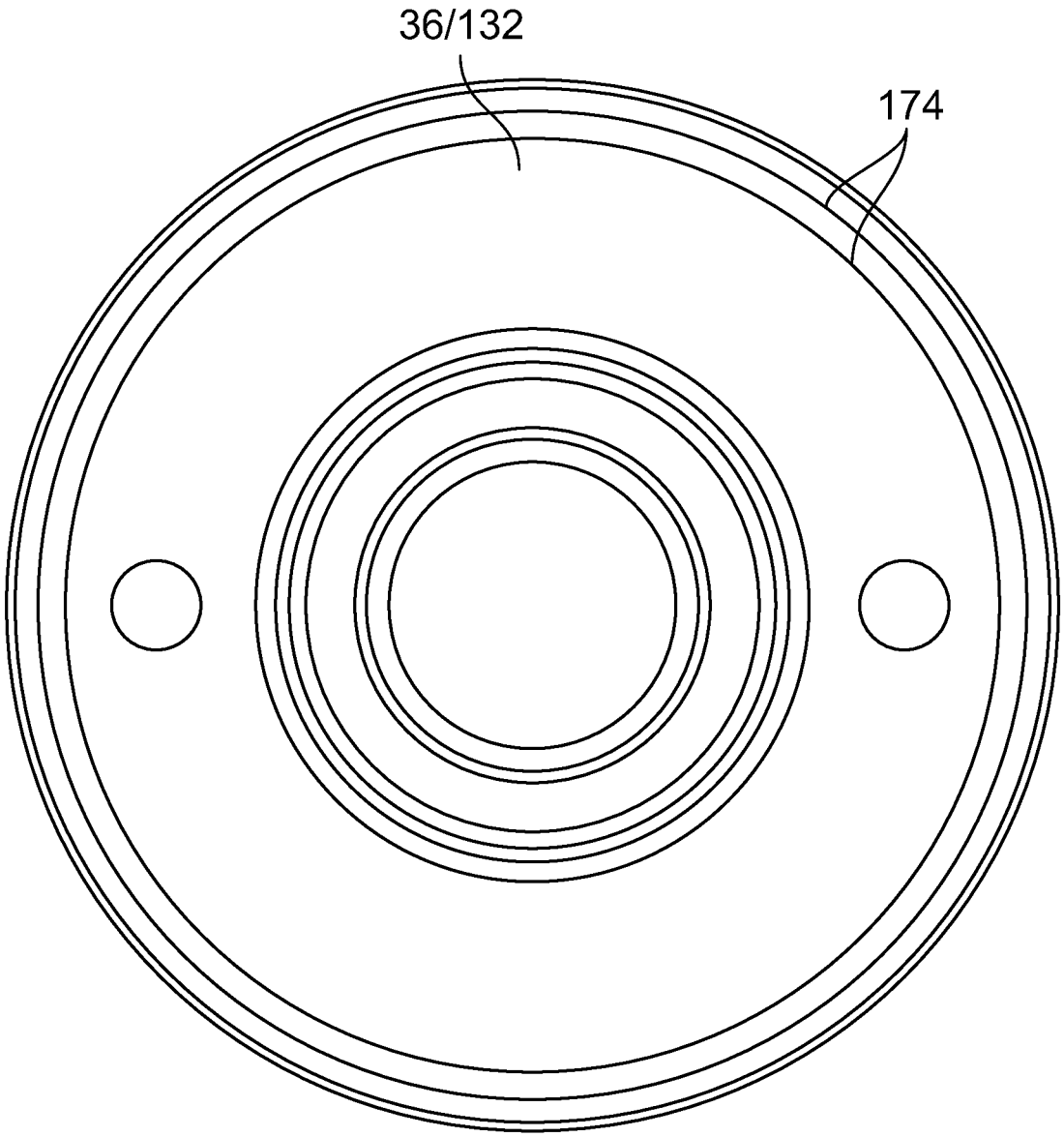
FIG. 32 is a top view of the floating puck or single pressure regulating valve of FIG. 31*a*.

In still other embodiments, as illustrated in FIGS. 31*a*, 31*b*, and 32, the top cap 162 has a plurality of barbs 174 that fishhook into the rubber or elastomer of the gasket 156, frictionally sealing the top cap 162 and gasket 156. This increases a threshold fuel system pressure necessary to flex the gasket 156 away from the top cap 162 and reduces the risk that air will leak out through the leak path 172. As illustrated in FIGS. 31*a* and 31*b*, the barbs 174 may project from both a top side and a bottom side of the top cap 162. However, in some embodiments, the barbs 174 may project from just one side, top or bottom, of the top cap 162. In some embodiments, there are two rows of barbs 174, extending circumferentially around a circumference of the top cap 162. See FIG. 32. In some embodiments, the barbs 174 only extend in one circle around the circumference of the top cap 162. In other embodiments, the barbs 174 extend in three or more circles. In still other embodiments, the barbs 174 are sporadically or evenly spaced along the circumference of the top cap 162 but do not form a continuous circle. In still other embodiments, the top cap 162 has a plurality of ridges, or other friction inducing protrusions other than barbs that amplify the frictional seal with the gasket 156.

Figure 33:
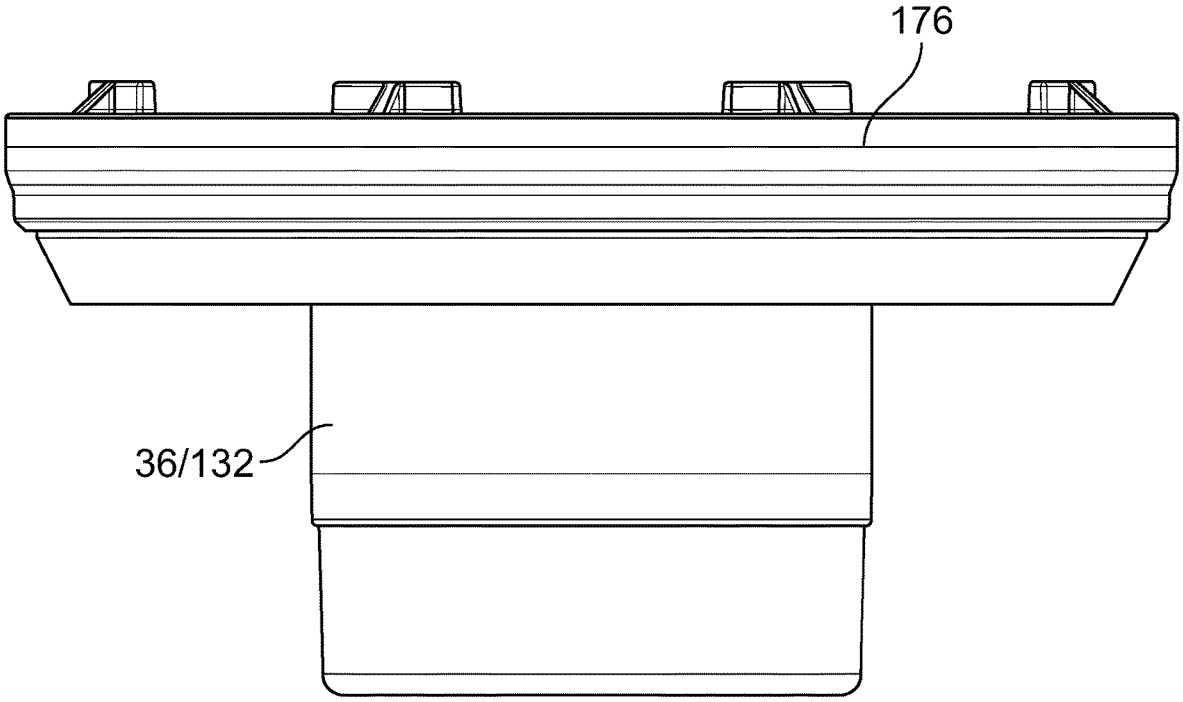
FIG. 33 is a perspective side view of a floating puck or single pressure regulating valve and a rigid crown, in accordance with embodiments of the current disclosure.
Figure 34:
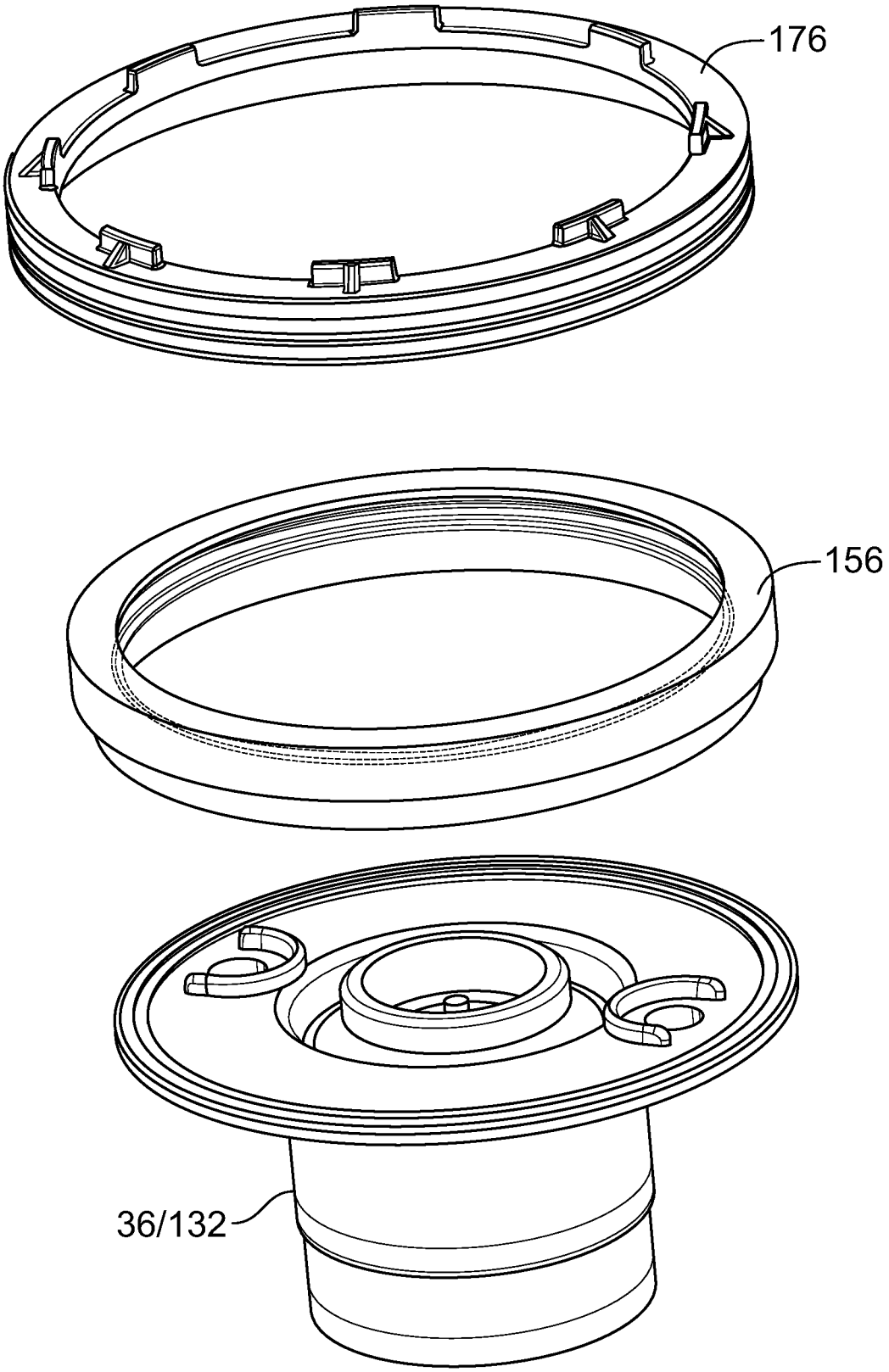
FIG. 34 is an exploded perspective view illustrating the positional relationship between the floating puck or single pressure regulating valve, the E-seal gasket, and the rigid crown of FIG. 33, in accordance with embodiments of the current disclosure.
Figure 35:
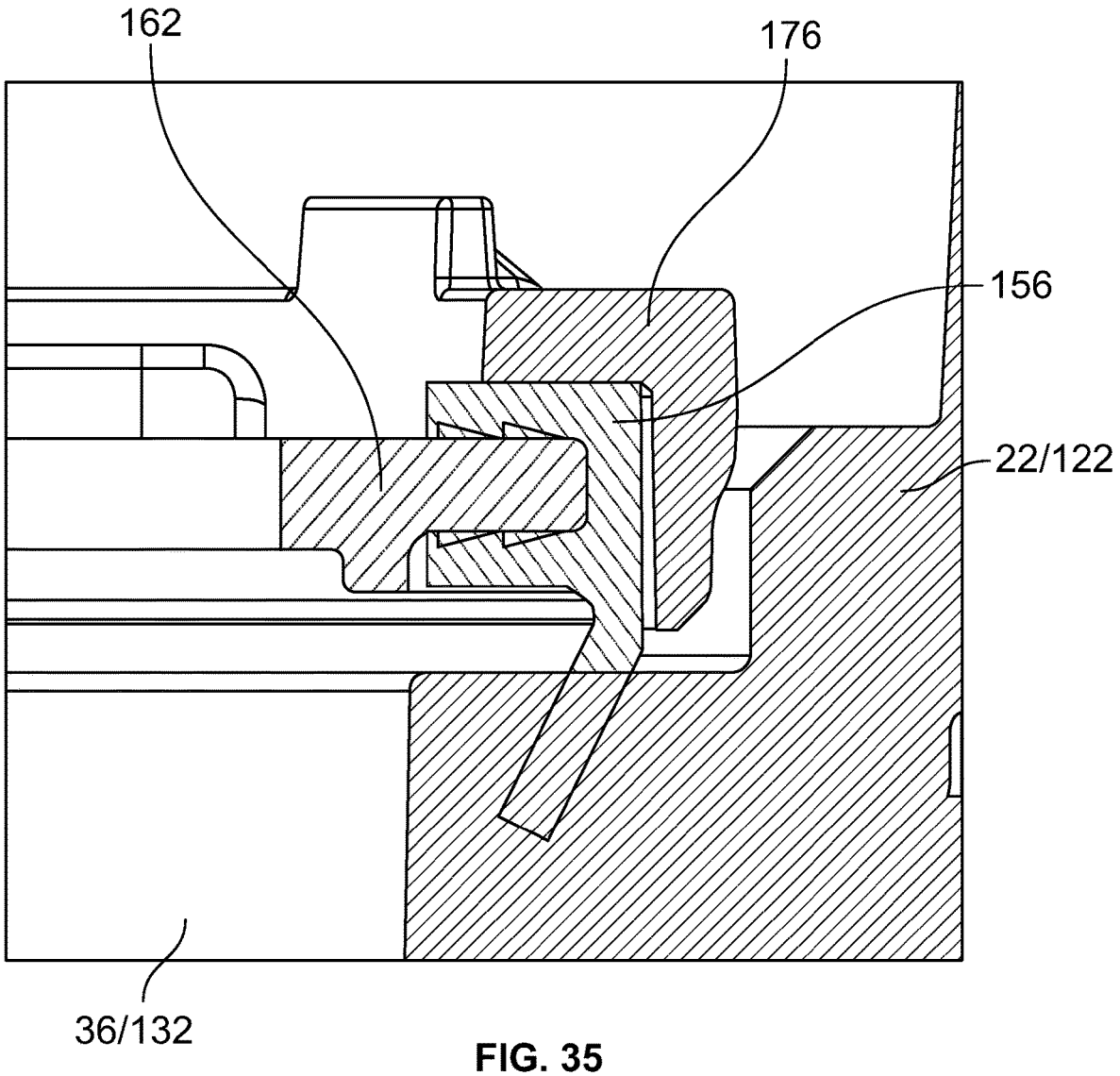
FIG. 35 is a cross section side view of the floating puck or single pressure regulating valve. E-seal gasket, and rigid crown of FIG. 34, in accordance with embodiments of the current disclosure.

FIG. 33 illustrates a preferred solution in a rigid crown 176, which sits between the gasket 156 (not shown) and the fuel cap 30, 130. FIG. 34 is an exploded view illustrating a positional relationship between the single pressure regulating valve 36 or puck 132, the E-seal gasket 156, and the rigid crown 176. FIG. 35 is cross section view illustrating the same. As noted above, the top cap 162 of the puck 132 or valve 36 inserts into the upper channel 158 of the gasket 156. The rigid crown 176 sits on top of a top segment 156*a* of the gasket 156, thereby holding it in place and preventing the seal from flexing radially away from the top cap 162.

The gasket 156 is thus positioned around the top cap 162 of the valve 36 or puck 132 and between the body 22, 122 of the deck fill 20, 120 and the rigid crown 176. In preferred embodiments, the body 22, 122, and the rigid crown 176 are both made up of a rigid, lightweight, moisture and rust resistant material such as hard plastic. In preferred embodiments, the body 22, 122 and rigid crown 176 are composed of glass filled nylon or acetyl plastics. As noted above, the gasket 156 is preferably composed of an elastomeric material such as a rubber. Thus, the soft and elastic gasket 156 can remain flexible and elastic, while being held in place between two rigid pieces. The elasticity of the rubber gasket 156 facilitates an airtight seal between the two rigid pieces that is effective in heat when the rubber of the gasket 156 expands, or in cold when the rubber contracts. Sandwiching the gasket 156 between the rigid body 22, 122 and the rigid crown 176 will also facilitate an airtight seal when the gasket 156 swells due to other factors such as humidity, hydrocarbon absorption, or heat aging.

Figure 36A:
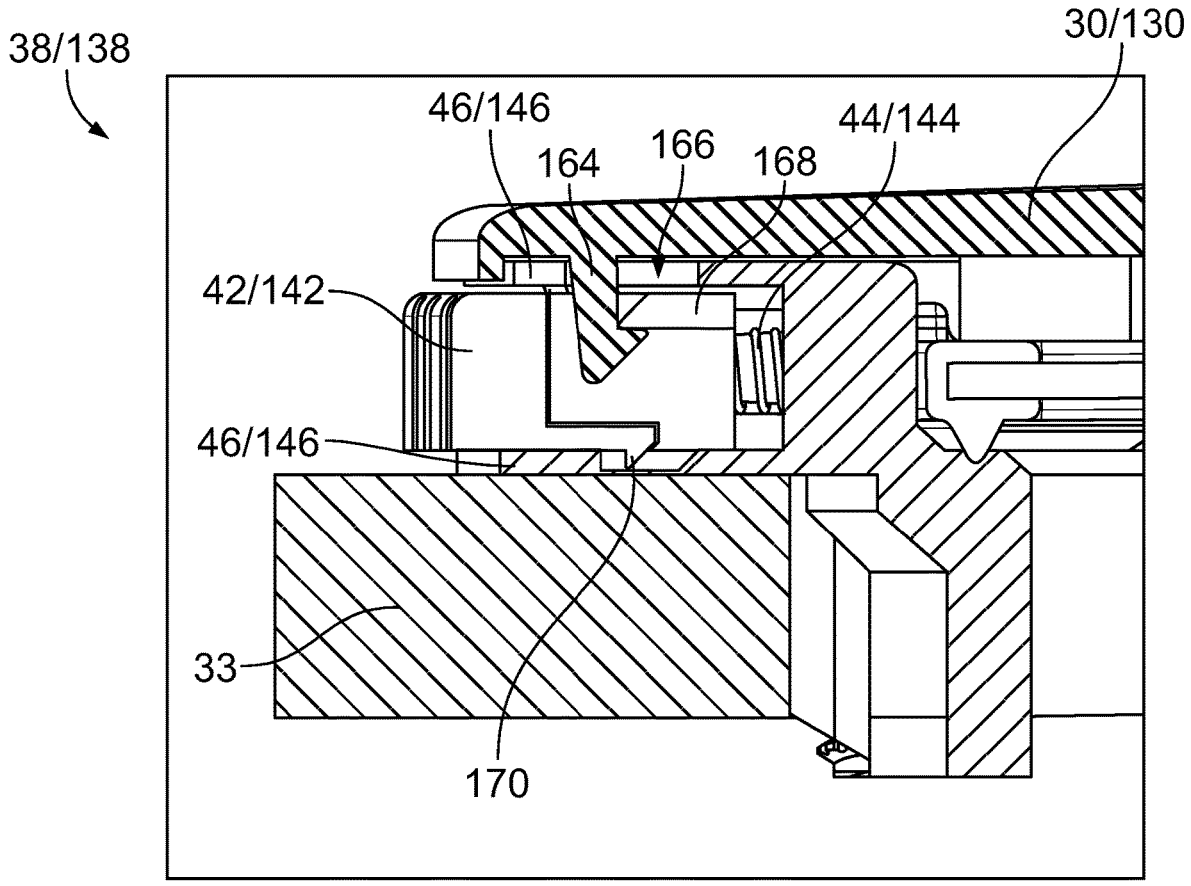
FIG. 36*a* is a cross section of a push button assembly in a latched position for vented and non-vented deck fills, as provided in accordance with an embodiment of the current disclosure.

The present disclosure also provides for embodiments of vented deck fills 20 and non-vented deck fills 120 wherein the fuel cap 30, 130 has a low profile. This feature is preferably enabled by the button assembly 38, 138 and hinge clearance scallops 40, 140, as illustrated in FIGS. 4, 22, and 36*a* and *b*. Where applicable in the figures, components of the button assembly 38, 138 and hinge clearance scallops 40, 140 are labeled in accordance with whether the figure illustrates a vented or non-vented deck fill 20, 120. Notwithstanding the use of different reference numerals in the embodiments, the component parts of the deck fill described in the current disclosure may be the same or similar and are present in embodiments of both vented and non-vented deck fills 20, 120 that utilize a low-profile fuel cap 30, 130 and/or hinge clearance scallops 40, 140.

FIGS. 4 and 22 illustrate the components of the hinge clearance scallops 40, 140, as described earlier in the specification. These components include the hinge pin 48, 148, around which the fuel cap 30, 130 rotates, as well as the torsion spring 50, 150.

Figure 36B:
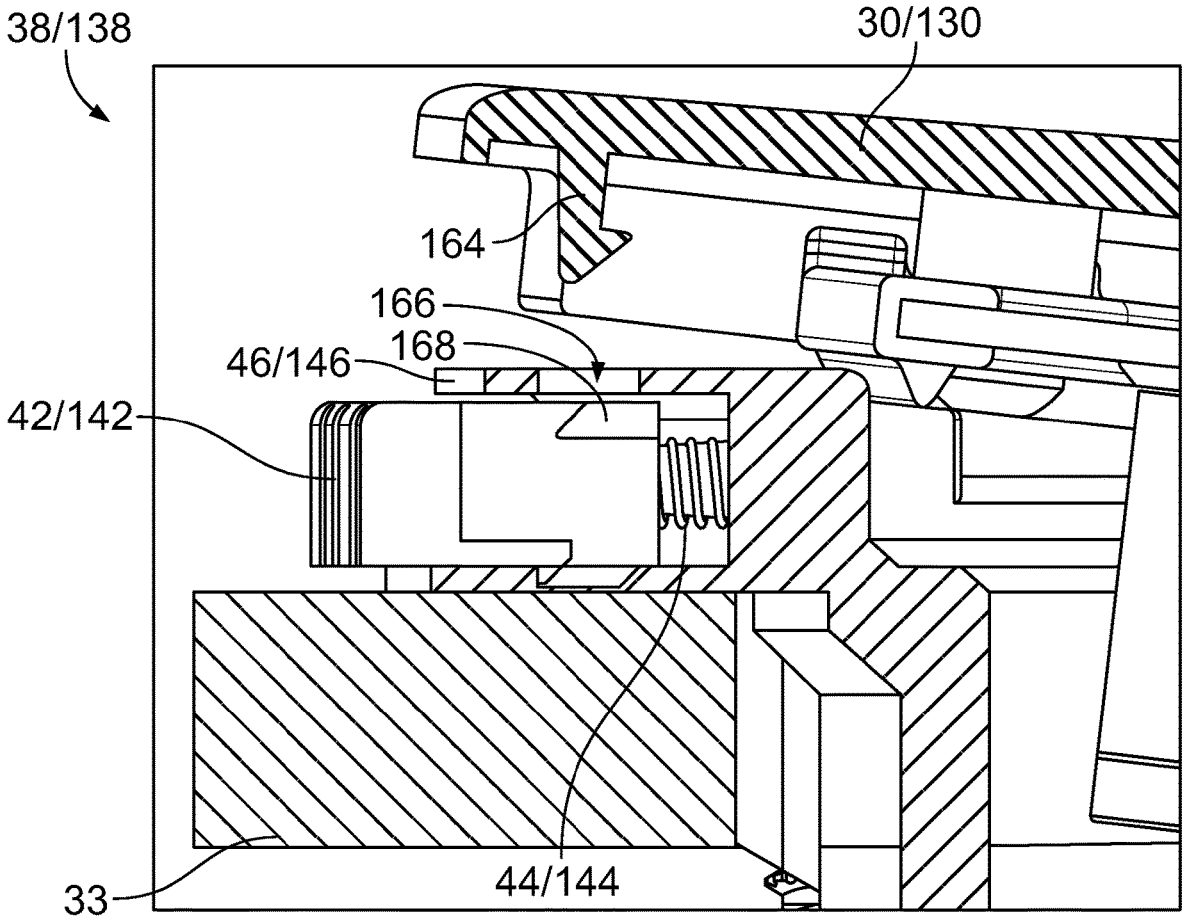
FIG. 36*b* is a cross section of the push button assembly of FIG. 36*a* in an unlatched position.

As illustrated in FIGS. 36*a* and 36*b*, the button assembly 38, 138 preferably includes the push button 42, 142 and the compression spring 44, 144 that sits within the button housing 46, 146. The button assembly 38, 138 is geometrically structured so that the fuel cap 30, 130 is latched unless the button 42, 142 is depressed. FIG. 36*a* illustrates the button assembly 38, 138 in a latched position wherein the fuel cap 30, 130 is closed. In preferred embodiments, the fuel cap 30, 130 additionally comprises a cap latch 164 that extends downward from the fuel cap 30, 130 through a latch entrance 166 in a top surface of the button 42, 142 when the fuel cap 30, 130 is in a closed position. In preferred embodiments, the cap latch 164 has a barbed shape, and the compression spring 44, 144 pushes the button 42, 142 such that cap latch 164 catches on a button ledge 168. Pushing the button 42, 142 compresses the compression spring 44, 144, allowing the cap latch 164 to disengage from the button ledge 168, allowing the fuel cap 30, 130 to open. In some embodiments, the button assembly 38, 138 has a single installation with a locking feature 170 molded into a bottom of the button housing 46, 146. FIG. 36*a* further illustrates the positional relationship of the button assembly 38, 138 when the deck fill 20, 120 is installed in the boat hull 33 or deck.

FIG. 36*b* illustrates the button assembly 38, 138 in an unlatched position wherein the fuel cap 30, 130 is open. In such instances, the compression spring 44, 144 pushes the button 42, 142 such that the latch entrance 166 is covered by the button housing 46, 146. Thus, when the fuel cap 30, 130 is open, the button housing 46, 146 prevents the latch entrance 166 from becoming clogged with debris.

In preferred embodiments for the vented deck fill 20 and the non-vented deck fill 200, the body 22, 122, fuel throat 26, 126, flange 28, 128, fuel cap 30, 130, and rigid crown 176 are composed of a lightweight, moisture and rust resistant material such as hard plastic. In preferred embodiments, the body 22, 122, fuel throat 26, 126, flange 28, 128, fuel cap 30, 130, and rigid crown 176 are composed of glass filled nylon or acetyl plastics. However other materials are envisioned by this disclosure, such as stainless steel. Components such as the valve seal 60, door seal 72, and mounting pad 135 are preferably composed of rubber as detailed elsewhere in this disclosure, or some other suitably elastic and compressible material.

While the invention is described through the above-described exemplary embodiments, modifications to, and variations of, the illustrated embodiments may be made without departing from the inventive concepts disclosed herein. For example, although specific parameter values, such as dimensions, materials, additives and coatings, may be recited in relation to disclosed embodiments, within the scope of the invention, the values of all parameters may vary over wide ranges to suit different applications.

As used herein, including in the claims, the term "and/or," used in connection with a list of items, means one or more of the items in the list, i.e., at least one of the items in the list, but not necessarily all the items in the list. As used herein, including in the claims, the term "or," used in connection with a list of items, means one or more of the items in the list, i.e., at least one of the items in the list, but not necessarily all the items in the list. "Or" does not mean "exclusive or."

Although aspects of embodiments may be described with reference to flowcharts and/or block diagrams, functions, operations, decisions, etc. of all or a portion of each block, or a combination of blocks, may be combined, separated into separate operations or performed in other orders.

Disclosed aspects, or portions thereof, may be combined in ways not listed above and/or not explicitly claimed. In addition, embodiments disclosed herein may be suitably practiced, absent any element that is not specifically disclosed herein. Accordingly, the invention should not be viewed as being limited to the disclosed embodiments.

| List of Elements | |
|---|---|
| Fuel System Components (In Accordance with the Prior Art): | |
| Fuel system | 10 |
| Fuel tank | 12 |
| Fuel fill | 14 |
| Fuel hose | 16 |
| Vent hose | 18 |
| Engine line | 19 |
| Vented Deck Fill Components: | |
| Vented Deck fill | 20 |
| Body | 22 |
| Vent throat body portion | 22a |
| Fuel throat body portion | 22b |
| Mouth | 24 |
| Mouth cross section area | 25 |
| Fuel throat | 26 |
| Fuel throat length | 27 |
| Flange | 28 |
| Flange outer diameter | 29 |
| Fuel cap | 30 |
| Fuel throat length | 31 |
| Vent throat | 32 |
| Boat hull | 33 |
| Atrium | 34 |
| Outer throat diameter | 35 |
| Single pressure regulating valve | 36 |
| Button assembly | 38 |

-continued

| List of Elements | |
|---|---|
| Hinge clearance scallop | 40 |
| Push button | 42 |
| Compression spring | 44 |
| Button housing | 46 |
| Hinge pin | 48 |
| Torsion spring | 50 |
| Plurality of machine screws | 52 |
| Plurality of deck screws | 54 |
| Flange holes (58-76 listed under "valve components" heading) | 56 |
| Vent throat entrance | 88 |
| Vented deck fill angle | 89 |
| Gap | 91 |
| Vent Throat Ring | 92 |
| Fuel Throat Ring | 93 |
| Plurality of exterior ribs | 94 |
| Distal vent end | 96 |
| Distal fuel end | 98 |
| Small hole | 100 |
| Large hole | 102 |
| Single hole | 104 |
| Vent throat major diameter | 105a |
| vent throat minor diameter | 105b |
| Fuel throat major diameter | 106a |
| Fuel throat minor diameter | 106b |
| Clearance | 107 |
| Plurality of centering ribs | 108 |
| Valve Components: | |
| Single pressure regulating valve | 36 |
| Valve working area | 57 |
| Top side | 58 |
| Bottom side | 59 |
| Valve seal | 60 |
| Detents | 61 |
| Valve body | 62 |
| Valve cap | 64 |
| Valve channel | 66 |
| Big door | 68 |
| Door hole | 69 |
| Small door | 70 |
| Door seal | 72 |
| Seal hole | 73 |
| Big Spring | 74 |
| Small Spring | 76 |
| Valve rod | 78 |
| Large chamber | 80 |
| Recess chamber | 82 |
| Negative pressure air flow | 84 |
| Positive pressure air flow | 86 |
| Non-Vented Deck Fill Components: | |
| Non-vented deck fill | 120 |
| Body | 122 |
| Mouth | 124 |
| Fuel throat | 126 |
| Flange | 128 |
| Fuel cap | 130 |
| Closing force | 131 |
| Puck | 132 |
| Puck screws | 133 |
| Puck body | 134 |
| Mounting pad | 135 |
| Sealing ring | 136 |
| Button assembly | 138 |
| Hinge clearance scallop | 140 |
| Push button | 142 |
| Compression spring | 144 |
| Button housing | 146 |
| Hinge pin | 148 |
| Torsion spring | 150 |
| Detents | 152 |
| Equalizing force | 153 |
| Plurality puck screw holes | 154 |

-continued

| List of Elements | |
|---|---|
| Other: | |
| Gasket | 156 |
| Top segment | 156a |
| Upper channel | 158 |
| Lower channel | 160 |
| Top cap | 162 |
| Cap latch | 164 |
| Latch entrance | 166 |
| Button ledge | 168 |
| Locking feature | 170 |
| Leak path | 172 |
| Barbs | 174 |
| Rigid crown | 176 |
| Non-Vented deck fill angle | 189 |

What is claimed is:

1. A vented deck fill for use in a vehicle, the vented deck fill comprising:

a cap;

a flange having a flange outer diameter and being connected to the cap;

an at least one pressure regulating valve;

a deck fill body, the deck fill body comprising:

a fuel throat body portion and a vent throat body portion;

a mouth having a mouth cross-sectional area;

an atrium;

a fuel throat defined by the fuel throat body portion, the fuel throat body portion having a fuel throat length; and a vent throat defined by the vent throat body portion, the vent throat body portion having a vent throat length, and the fuel throat body portion and the vent throat body portion having an outer throat diameter;

wherein the at least one pressure regulating valve is seated on the flange and extends through the mouth into the atrium;

wherein the flange outer diameter is greater than or equal to the outer throat diameter;

wherein the at least one pressure regulating valve has a valve working area that is between 3% and 25% of the mouth cross-sectional area.

2. The vented deck fill of claim 1, wherein the fuel throat body portion has an elliptical cross-section along at least a majority of the fuel throat length, and wherein the vent throat body portion has an elliptical cross-section along at least a majority of the vent throat length.

3. The vented deck fill of claim 1, wherein the at least one pressure regulating valve comprises a single pressure regulating valve and has a valve working area that is between 5% and 10% of the mouth cross-sectional area.

4. The vented deck fill of claim 1, further comprising a hinge clearance scallop and a button assembly, wherein the hinge clearance scallop hingedly connects the cap to the flange.

5. The vented deck fill of claim 1, further comprising a plurality of exterior ribs along the fuel throat length and a plurality of exterior ribs along the vent throat length.

6. The vented deck fill of claim 1, further comprising a vent throat ring on the vent throat body portion and a fuel throat ring on the fuel throat body portion, wherein the vent throat body portion is configured to connect to a fuel line of a fuel system and the vent throat body portion is configured to connect to a vent line of the fuel system.

7. The vented deck fill of claim 1, further comprising a gap defined by the fuel throat body portion and the vent throat body portion, the gap having a length that is less than 20% of the outer throat diameter.

8. A method of vented deck fill installation in a marine vehicle, the method comprising the steps of:

providing a boat hull of the marine vehicle;

providing a deck fill comprising:

a cap;

a flange having a flange outer diameter;

at least one pressure regulating valve;

a deck fill body, the deck fill body comprising:

a fuel throat body portion and a vent throat body portion;

a mouth having a mouth cross-sectional area;

an atrium;

a fuel throat defined by the fuel throat body portion, the fuel throat body portion having a fuel throat length; and a vent throat defined by the vent throat body portion, the vent throat body portion having a vent throat length, and the fuel throat body portion and the vent throat body portion having an outer throat diameter;

wherein the at least one pressure regulating valve is seated on the flange and extends through the mouth into the atrium;

wherein the flange outer diameter is greater than or equal to the outer throat diameter;

drilling a single circular hole into the boat hull, the singular circular hole having a diameter that is greater than or equal to the outer throat diameter; and inserting the vented deck fill into the single circular hole.

9. The method of claim 8, the deck fill body further comprising a plurality of centering ribs extending radially from the deck fill body, and the method further comprising the step of using the centering ribs to align the vented deck fill during insertion into the single circular hole drilled into the boat hull.

10. The method of claim 8, the vent throat body portion further comprising a vent throat ring and the fuel throat body portion further comprising a fuel throat ring, and the method further comprising the steps of attaching the vented deck fill to the boat hull with a plurality of fasteners, connecting a fuel line to the fuel throat body portion along the fuel throat length at or below the fuel throat ring, and connecting the vent line to the vent throat body portion along the vent throat length at or below the vent throat ring.

11. A non-vented deck fill for use in a vehicle, the non-vented deck fill comprising:

a cap;

a flange connected to the cap;

a floating puck assembly comprising:

a puck body having a top side;

a mounting pad affixed to the top side of the puck body and comprising a sealing ring, the sealing ring comprising a biasing means;

a deck fill body, the deck fill body comprising:

a fuel throat body portion;

a mouth having a mouth cross-sectional area;

an atrium;

a fuel throat defined by the fuel throat body portion, the fuel throat body portion having a fuel throat length;

wherein the floating puck assembly is seated on the flange and extends through the mouth into the atrium.

12. The non-vented deck fill of claim 11, further comprising a hinge clearance scallop, wherein the hinge clearance scallop hingedly connects the cap to the flange.

13. The non-vented deck fill of claim 11, wherein the biasing means is a plurality of detents forming a portion of the sealing ring.

14. The non-vented deck fill of claim 13, wherein when a closing force is applied to the fuel cap toward the flange, the detents are configured to equalize a force applied to the floating puck assembly corresponding to the closing force.

15. A deck fill for use in a vehicle, the deck fill comprising:

a cap;

a flange connected to the cap;

at least one pressure regulating valve or a floating puck assembly, the floating puck assembly comprising:

a puck body having a top side;

a mounting pad affixed to the top side of the puck body and comprising a sealing ring, the sealing ring comprising a biasing means;

a gasket defining an upper channel and a lower channel, the at least one pressure regulating valve or the floating puck assembly being seated in the upper channel of the gasket;

a deck fill body, the deck fill body comprising:

a fuel throat body portion;

a mouth having a mouth cross-sectional area;

an atrium;

a fuel throat defined by the fuel throat body portion, the fuel throat body portion having a fuel throat length; and a hinge clearance scallop configured to hingedly connect the cap to the flange;

wherein the at least one pressure regulating valve or the floating puck and extends through the mouth into the atrium.

16. The deck fill of claim 15, wherein the gasket is formed of an elastomeric material having a Youngs Modulus of greater than 14.7 megapascals.

17. The deck fill of claim 15, the at least one pressure regulating valve or the floating puck assembly further comprising a top cap, the top cap being seated in the upper channel of the gasket.

18. The deck fill of claim 17, the top cap comprising barbs configured to engage the upper channel of the gasket and frictionally seal the top cap and gasket.

19. The deck fill of claim 15, further comprising a rigid crown between the cap and the gasket.

* * * * *